US009961965B2

(12) United States Patent
Miner

(10) Patent No.: US 9,961,965 B2
(45) **Date of Patent: *May 8, 2018**

(54) SOLE STRUCTURE COMPRISING A FLUID FILLED MEMBER WITH SLOTS

(71) Applicant: NIKE, Inc., Beaverton, OR (US)

(72) Inventor: Mark C. Miner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 427 days.

This patent is subject to a terminal disclaimer.

(21) Appl. No.: 14/244,006

(22) Filed: Apr. 3, 2014

(65) Prior Publication Data

US 2014/0290094 A1 Oct. 2, 2014

Related U.S. Application Data

(63) Continuation of application No. 12/860,153, filed on Aug. 20, 2010, now Pat. No. 8,732,986.

(51) Int. Cl.

| | |
|---|---|
| ***A43B 3/00*** | (2006.01) |
| ***A43B 13/14*** | (2006.01) |
| ***A43B 13/20*** | (2006.01) |
| ***A43D 8/00*** | (2006.01) |
| ***A43B 13/16*** | (2006.01) |
| ***A43B 13/18*** | (2006.01) |
| ***A43D 8/02*** | (2006.01) |

(52) U.S. Cl.

CPC ..... *A43D 8/00* (2013.01); *A43B 3/0052* (2013.01); *A43B 13/141* (2013.01); *A43B 13/16* (2013.01); *A43B 13/184* (2013.01); *A43B 13/20* (2013.01); *A43D 8/02* (2013.01)

(58) Field of Classification Search

CPC ..... A43B 3/0052; A43B 13/141; A43B 13/16; A43B 13/184; A43B 13/189; A43B 13/20

USPC ..... 36/25 R, 28, 29, 30 A, 31

See application file for complete search history.

(56) References Cited

U.S. PATENT DOCUMENTS

| | | | |
|---|---|---|---|
| 3,720,971 | A | 3/1973 | Wyness et al. |
| 4,183,156 | A | 1/1980 | Rudy |
| 4,219,945 | A | 9/1980 | Rudy |
| D261,325 | S | 10/1981 | Niro |
| 4,309,831 | A | 1/1982 | Pritt |
| D275,148 | S | 8/1984 | Bergmans |
| 4,578,882 | A | 4/1986 | Talarico, II |
| D294,421 | S | 3/1988 | Le |
| D294,653 | S | 3/1988 | Le |
| 4,936,029 | A | 6/1990 | Rudy |

(Continued)

FOREIGN PATENT DOCUMENTS

| | | |
|---|---|---|
| CH | 698 210 B1 | 6/2009 |
| CH | 698210 B1 | 6/2009 |

(Continued)

OTHER PUBLICATIONS

First Office Action dated Aug. 17, 2015 for Chinese Application No. CN201180050537.3 filed Apr. 19, 2013.

(Continued)

*Primary Examiner* — Sharon M Prange
(74) *Attorney, Agent, or Firm* — Banner & Witcoff, Ltd.

(57) ABSTRACT

A sole structure for an article of footwear is disclosed. The sole structure comprises a fluid filled member and a plurality of slots. The slots are associated with connecting portions that connect portions of the sole structure in the generally longitudinal direction and provide for increased fit, flexibility and stability.

20 Claims, 18 Drawing Sheets

(56) References Cited

U.S. PATENT DOCUMENTS

| | | | |
|---|---|---|---|
| 5,042,176 | A | 8/1991 | Rudy |
| D322,881 | S | 1/1992 | Bushman |
| 5,191,727 | A | 3/1993 | Barry et al. |
| 5,713,141 | A | 2/1998 | Mitchell et al. |
| 5,797,199 | A | 8/1998 | Miller et al. |
| 5,952,065 | A | 9/1999 | Mitchell et al. |
| 6,009,637 | A | 1/2000 | Pavone |
| 6,013,340 | A | 1/2000 | Bonk et al. |
| 6,023,859 | A | 2/2000 | Burke et al. |
| 6,082,025 | A | 7/2000 | Bonk et al. |
| 6,127,026 | A | 10/2000 | Bonk et al. |
| 6,203,868 | B1 | 3/2001 | Bonk et al. |
| 6,321,465 | B1 | 11/2001 | Bonk et al. |
| D474,580 | S | 5/2003 | Pollastrelli |
| D475,508 | S | 6/2003 | Pollastrelli |
| 6,931,764 | B2 | 8/2005 | Swigart et al. |
| 6,966,128 | B2 | 11/2005 | McClaskie |
| 6,976,320 | B2 | 12/2005 | McClaskie |
| 7,096,603 | B2 | 8/2006 | Fusco |
| 7,290,357 | B2 | 11/2007 | McDonald et al. |
| 7,350,320 | B2 | 4/2008 | Chandler et al. |
| 7,401,418 | B2 | 7/2008 | Wyszynski et al. |
| 7,401,419 | B2 | 7/2008 | Lucas et al. |
| D574,582 | S | 8/2008 | Della Valle |
| D577,179 | S | 9/2008 | Della Valle |
| D577,181 | S | 9/2008 | Della Valle |
| 7,562,469 | B2 | 7/2009 | Dojan |
| 7,637,033 | B2 | 12/2009 | Sokolowski et al. |
| 7,704,430 | B2 | 4/2010 | Johnson et al. |
| 7,731,883 | B2 | 6/2010 | Johnson et al. |
| 8,001,703 | B2 | 8/2011 | Schindler et al. |
| 8,151,485 | B2 | 4/2012 | Hurd et al. |
| 8,387,279 | B2 | 3/2013 | Pauk et al. |
| 8,661,717 | B2 | 3/2014 | Miner |
| 8,689,467 | B2 | 4/2014 | Miner |
| 8,732,986 | B2 | 5/2014 | Miner |
| 2004/0024645 | A1 | 2/2004 | Potter et al. |
| 2005/0071242 | A1 | 3/2005 | Allen et al. |
| 2006/0117604 | A1 | 6/2006 | Fusco |
| 2006/0201028 | A1 | 9/2006 | Chan et al. |
| 2006/0288612 | A1 | 12/2006 | Lucas et al. |
| 2007/0039204 | A1 | 2/2007 | Wyszynski et al. |
| 2007/0169376 | A1 | 7/2007 | Hatfield et al. |
| 2007/0199211 | A1 | 8/2007 | Campbell |
| 2007/0199213 | A1 | 8/2007 | Campbell et al. |
| 2008/0022553 | A1 | 1/2008 | McDonald et al. |
| 2008/0184595 | A1 | 8/2008 | Schindler et al. |
| 2008/0216355 | A1 | 9/2008 | Becker et al. |
| 2008/0244926 | A1 | 10/2008 | Yu et al. |
| 2008/0289224 | A1 | 11/2008 | Sink |
| 2009/0071040 | A1 | 3/2009 | Fergus |
| 2009/0091451 | A1 | 4/2009 | Jones et al. |
| 2009/0178303 | A1 | 7/2009 | Hurd et al. |
| 2010/0083535 | A1 | 4/2010 | Meschter et al. |
| 2010/0154257 | A1 | 6/2010 | Bosomworth et al. |
| 2010/0269271 | A1 | 10/2010 | Kim et al. |
| 2012/0042539 | A1 | 2/2012 | Miner |
| 2012/0042540 | A1 | 2/2012 | Miner |
| 2012/0042541 | A1 | 2/2012 | Miner |
| 2014/0189965 | A1 | 7/2014 | Miner |
| 2014/0223672 | A1 | 8/2014 | Miner |
| 2014/0289977 | A1 | 10/2014 | Miner |
| 2014/0290094 | A1 | 10/2014 | Miner |

FOREIGN PATENT DOCUMENTS

| | | | |
|---|---|---|---|
| CN | 1127101 | A | 7/1996 |
| CN | 1817261 | A | 8/2006 |
| CN | 1901822 | A | 1/2007 |
| CN | 101378671 | A | 3/2009 |
| CN | 101404906 | A | 4/2009 |
| CN | 101642307 | A | 2/2010 |
| CN | 103179873 | A | 6/2013 |
| CN | 103200832 | A | 7/2013 |
| CN | 103200833 | A | 7/2013 |
| DE | 10 2005 006 267 | B3 | 3/2006 |
| EP | 1 787 540 | A1 | 5/2007 |
| EP | 1787540 | A1 | 5/2007 |
| EP | 1 857 004 | A1 | 11/2007 |
| EP | 2 198 729 | A1 | 6/2010 |
| EP | 2 277 402 | A2 | 1/2011 |
| EP | 2 732 717 | A1 | 5/2014 |
| WO | 2009/091451 | A1 | 7/2009 |
| WO | 2010042381 | A2 | 4/2010 |
| WO | 2012/024456 | A1 | 2/2012 |
| WO | 2012/024457 | A1 | 2/2012 |
| WO | 2012/024458 | A1 | 2/2012 |

OTHER PUBLICATIONS

Office Action dated Sep. 30, 2015 in Chinese Patent Application No. 201180050502.X, and the English translation thereof.

Response to Chinese Office Action as filed on Jan. 4, 2016 for Chinese Patent Application No. 201180050537.3.

Notice of Allowance dated Jan. 29, 2016 for Chinese Patent Application No. 201180050537.3, and the English translation thereof.

Response filed Mar. 9, 2015 in Chinese Patent Application No. 201180050554.7.

Office Action dated Dec. 1, 2014 in Chinese Patent Application No. 201180050502.X.

Office Action dated Oct. 24, 2014 in Chinese Patent Application No. 201180050554.7.

Voluntary Amendments filed Sep. 18, 2013 in European Patent Application No. 11749669.5.

Voluntary Amendments filed Sep. 18, 2013 in European Patent Application No. 11770209.2.

Voluntary Amendments filed Sep. 20, 2013 in European Patent Application No. 11770210.0.

International Search Report and Written Opinion dated Dec. 22, 2011 in PCT/US2011/048165.

International Preliminary Report on Patentability (including Written Opinion of the ISA) dated Mar. 7, 2013 in International Application No. PCT/US2011/048163.

International Preliminary Report on Patentability (including Written Opinion of the ISA) dated Mar. 7, 2013 in International Application No. PCT/US2011/048164.

International Preliminary Report on Patentability (including Written Opinion of the ISA) dated Mar. 7, 2013 in International Application No. PCT/US2011/048165.

Office Action dated Mar. 20, 2013 in U.S. Appl. No. 12/860,153.

International Search Report and Written Opinion dated Dec. 1, 2011 in PCT/US2011/048164.

Office Action dated Feb. 28, 2013 in U.S. Appl. No. 12/860,173.

International Search Report and Written Opinion dated Dec. 22, 2011 in PCT/US2011/048163.

European Search Report dated Apr. 11, 2014 in European Patent Application No. 13197582.3.

Dec. 22, 2011—(WO) ISR & WO—App. No. PCT/US2011/048163.

SOLE STRUCTURE COMPRISING A FLUID FILLED MEMBER WITH SLOTS

CROSS REFERENCE TO RELATED APPLICATION

This application is a continuation of U.S. patent application Ser. No. 12/860,153, filed Aug. 20, 2010 (published as U.S. Patent Application Publication Number 2012/0042539 on Feb. 23, 2012), which is incorporated by reference in its entirety.

BACKGROUND

The present embodiments relate generally to an article of footwear, and in particular to an article of footwear with grooves and a method of making the article.

Another commonly owned application to Miner, U.S. patent publication number 2012/0042541, published Feb. 23, 2012, entitled "Article of Footwear with Slots and Method of Making," hereby referred to as "the slotted sole case," filed on even date with this application, is incorporated by reference in its entirety.

Articles of footwear with slots or grooves are known. Meschter et al. (U.S. patent application publication number 2010/0083535), the entirety of which is incorporated by reference, teaches an article of footwear having an upper decoupled from the sole in a midfoot region. Shaffer teaches lateral and medial recesses that are cut into the side of the sole in the longitudinal direction.

Fergus (U.S. patent application publication number 2009/0071040) teaches a felt sole with improved traction. The felt sole has integral downwardly extending protrusions located over the bottom surface of the felt sole. Fergus teaches that methods for creating the traction pattern can include cutting or laser burning the pattern into one surface of the flat felt sheet.

Campbell (U.S. patent application publication number 2007/0199211) teaches a flexible foot-support structure. Campbell teaches a shoe with an outsole that includes at least two recessed segments extending in a longitudinal direction in the forefoot portion. Campbell teaches that the recessed segments can be provided in the sole structure in any desired manner, such as during a sole member molding process, by a cutting action (e.g. using knives, lasers, etc.), and/or any other manner.

McClaskie (U.S. Pat. No. 6,976,320) teaches a sandal or shoe having an outsole with a sock lining on top of and in direct contact with the outsole for directing contact of a user's foot and a cushion having a thickness between approximately ⅛ and 1½ inches, where the cushion is placed between the outsole and the sock lining. McClaskie teaches a notch, which is any recess, indentation, relief, channel groove, or etching in the side surface of the outsole sufficient to provide clearance for the securing mechanism. McClaskie further teaches that the notch can be formed using machining, molding, grinding, etching or laser cutting.

The related art lacks provisions for enhancing stability, flexibility and fit simultaneously in a sole structure. There is a need for articles that address the limitations of the related art.

SUMMARY

In one aspect, the invention provides an article of footwear, comprising: a sole structure including a longitudinal direction associated with a length of the sole structure, a lateral direction associated with a width of the sole structure and a vertical direction that is generally perpendicular to the longitudinal direction and the lateral direction; the sole structure including a first slot disposed on a side portion of the sole structure and a second slot disposed on a lower portion of the sole structure; the first slot extending approximately in the vertical direction on the side portion and the second slot extending approximately in the lateral direction on the lower portion; the first slot being and the second slot having substantially similar positions with respect to the longitudinal direction; a connecting portion extending between a first portion of the sole structure and a second portion of the sole structure, the connecting portion having a substantially different cross sectional shape than the first portion and the second portion; the connecting portion separating the first slot from the second slot; and wherein the connecting portion comprises an internal cavity that is filled with fluid.

In another aspect, the invention provides an article of footwear, comprising: a sole structure including a fluid filled member, the fluid filled member including an internal cavity filled with a fluid; the fluid filled member including a side portion, a lower portion and an upper portion; a lower periphery disposed between the side portion and the lower portion; an upper periphery disposed between the side portion and the upper portion; a first slot disposed in the side portion and a second slot disposed in the lower portion; a first connecting portion being disposed between the first slot and the upper portion, the first connecting portion extending to the upper periphery; a second connecting portion being disposed between the first slot and the second slot, the second connecting portion extending to the lower periphery; the internal cavity extending through the first connecting portion and the second connecting portion; and wherein the first connecting portion is configured to move substantially independently of the second connecting portion.

In another aspect, the invention provides an article of footwear, comprising: a sole structure comprising a fluid filled member; the fluid filled member including a portion with a channel, the channel being configured to receive a plurality of segmented portions; and wherein the plurality of segmented portions are spaced apart from one another in a longitudinal direction in a manner that forms slots on the portion.

In another aspect, the invention provides a method of making an article of footwear, comprising the steps of: receiving a fluid filled member including an internal cavity, the fluid filled member including at least one thickened portion; forming a plurality of slots in the thickened portion; and wherein a portion of each slot in the plurality of slots is disposed adjacent to the internal cavity.

In another aspect, the invention provides a method of making an article of footwear, comprising the steps of: receiving a supporting member with a hollow cavity, the supporting member including at least one thickened portion; receiving a fluid filled member, the fluid filled member including an internal cavity; forming a plurality of slots in at least one thickened portion of the support member; inserting the fluid filled member into the hollow cavity of the supporting member; and bonding the fluid filled member to the supporting member to form a sole structure for the article of footwear.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
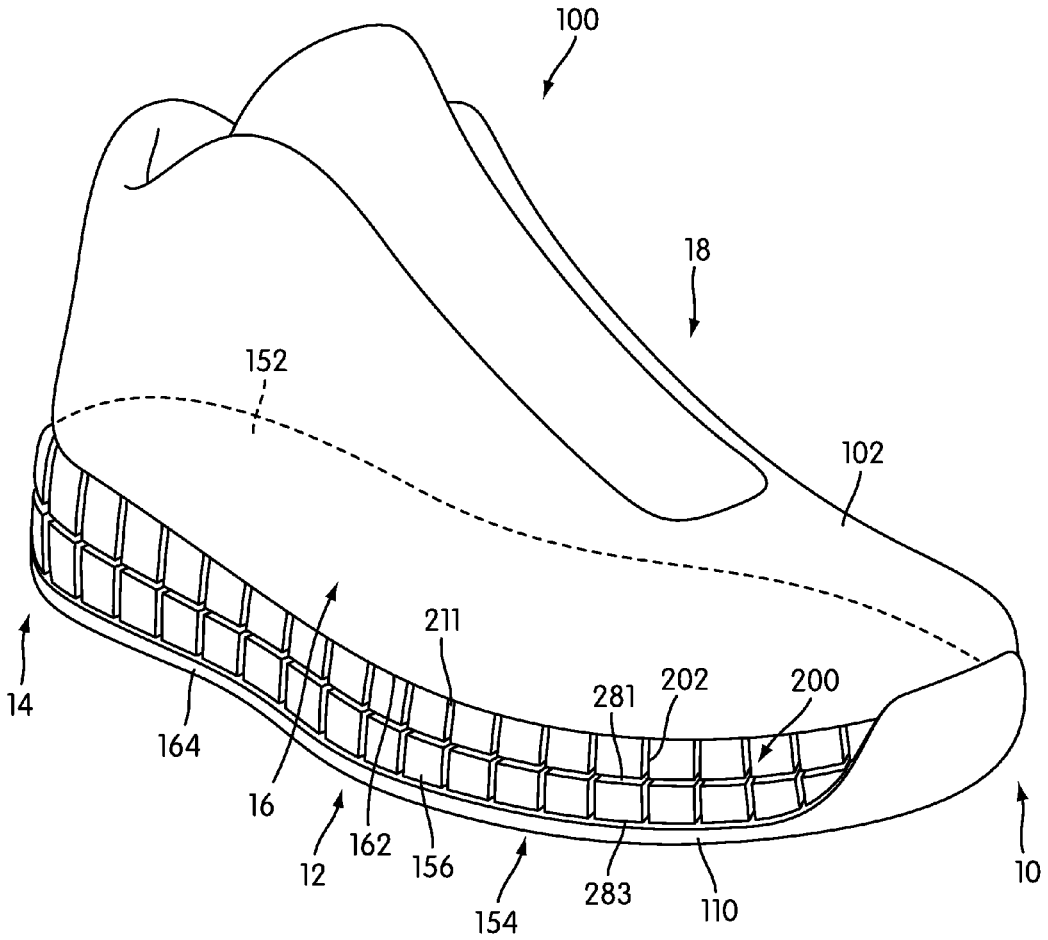
FIG. 1 is an isometric view of an embodiment of an article of footwear including a plurality of slots.
Figure 2:
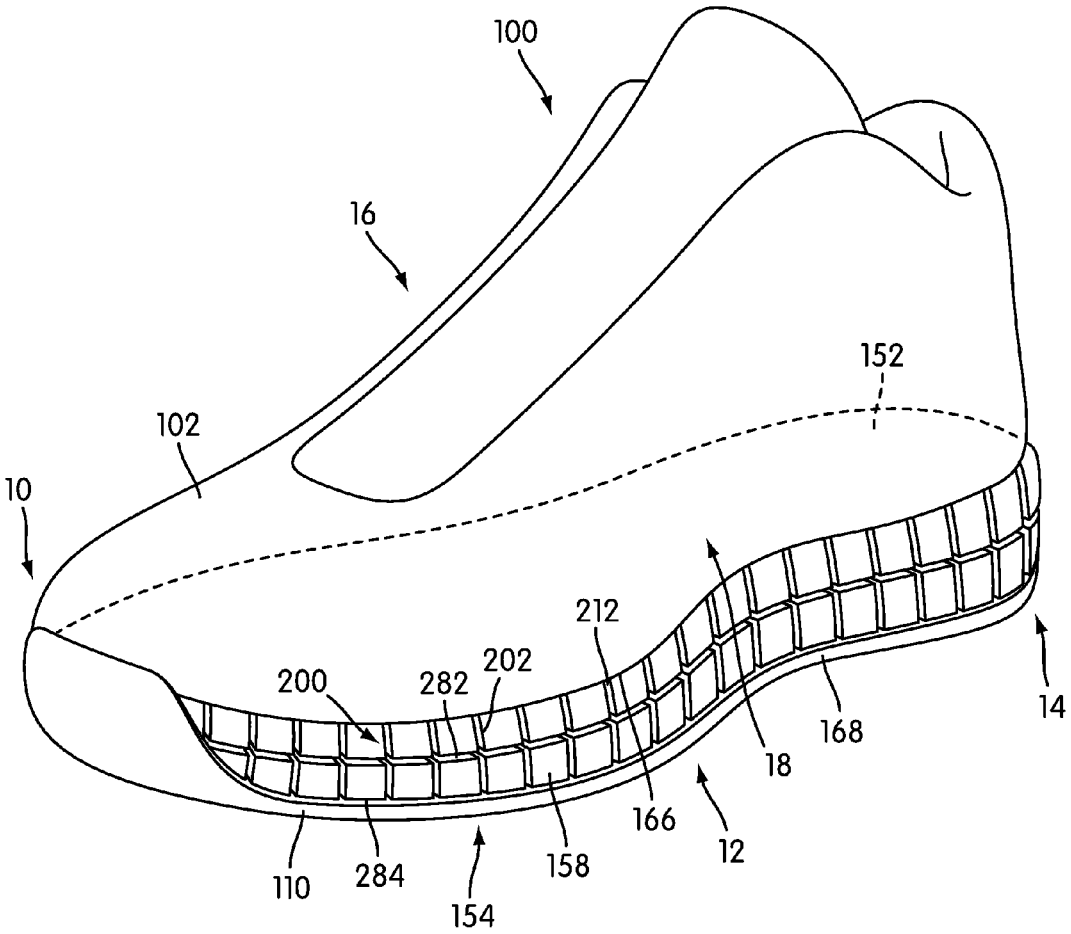
FIG. 2 is an isometric view of an embodiment of an article of footwear including a plurality of slots.
Figure 3:
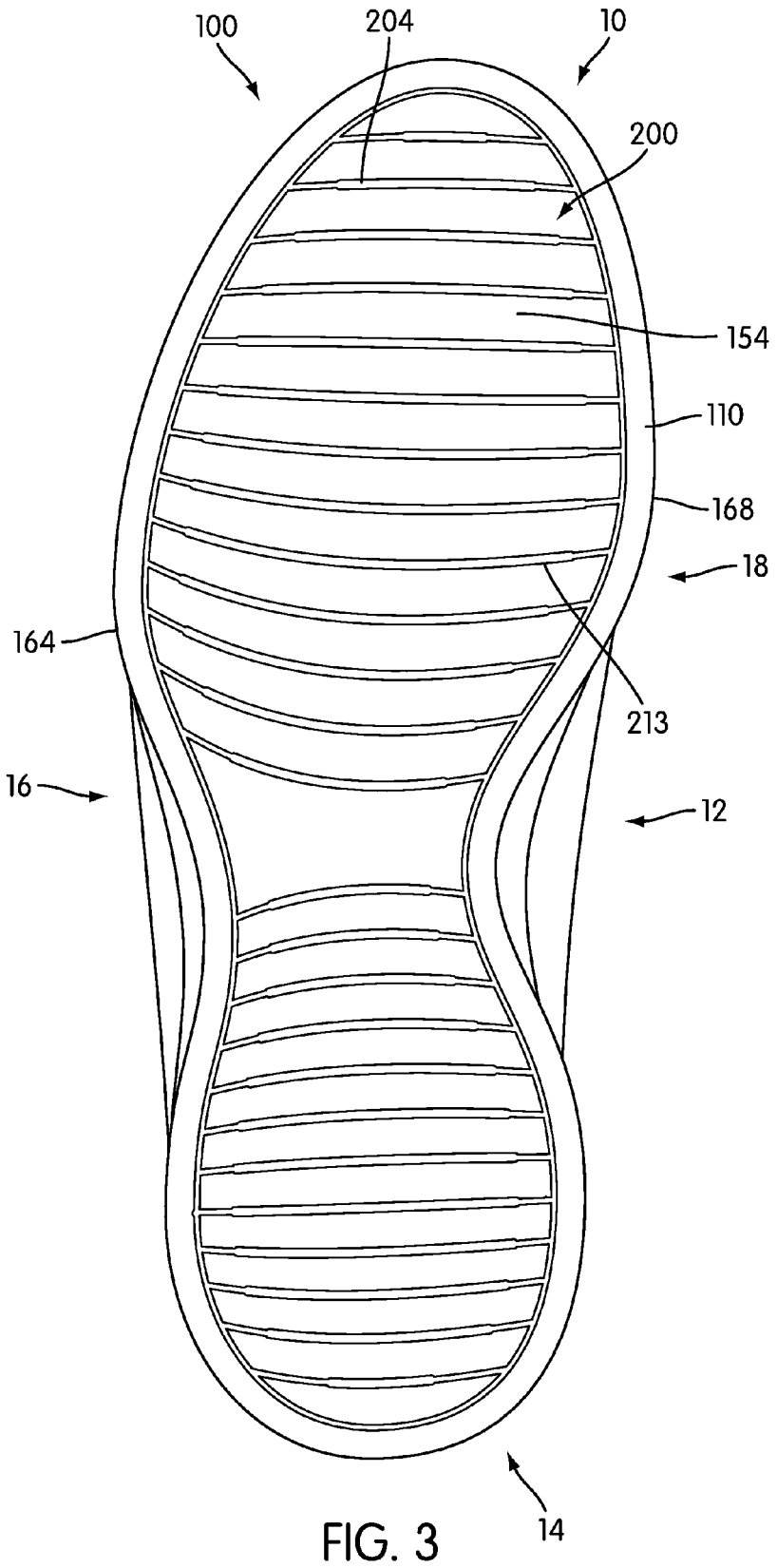
FIG. 3 is a bottom view of an embodiment of an article of footwear including a plurality of slots.

FIGS. 1 through 3 illustrate views of an exemplary embodiment of article of footwear 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. As shown in FIGS. 1 through 3, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 3, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Sole structure 110 can include upper portion 152 (seen in phantom in FIGS. 1 and 2) and lower portion 154 disposed opposite of upper portion 152. In some cases, upper portion 152 can be disposed adjacent to upper 102. In addition, in some cases, lower portion 154 can be a ground contacting surface. Sole structure 110 can further include lateral side portion 156 and medial side portion 158. Lateral side portion 156 may extend between upper portion 152 and lower portion 154 on lateral side 16 of sole structure 110. Likewise, medial side portion 158 may extend between upper portion 152 and lower portion 154 on medial side 18 of sole structure 110.

In some embodiments, sole structure 110 can include lateral upper periphery 162 disposed between lateral side portion 156 and upper portion 152. Also, sole structure 110 can include lateral lower periphery 164 disposed between lateral side portion 156 and lower portion 154. Furthermore, sole structure 110 can include medial upper periphery 166 disposed between medial side portion 158 and upper portion 152. Also, sole structure 110 can include medial lower periphery 168 disposed between medial side portion 158 and lower portion 154.

A sole structure can include provisions for increasing flexibility, fit and stability for an article of footwear. In some embodiments, a sole structure can be provided with one or more slots. In some cases, slots can be provided on a side portion of the sole structure. In other cases, slots can be provided on a lower portion of the sole structure. In one embodiment, slots can be provided on side portions of the sole structure as well as on lower portions of the sole structure.

In one embodiment, sole structure 110 can include plurality of slots 200. Generally, plurality of slots 200 can comprise various slots arranged in a variety of orientations and in a variety of locations on sole structure 110. For example, in some embodiments, plurality of slots 200 may include first slot set 202 that extend in a generally vertical direction on lateral side portion 156 and medial side portion 158. Additionally, plurality of slots 200 may include first longitudinal slot 281 that extends in a longitudinal direction along lateral side portion 156 and second longitudinal slot 282 that extends in a longitudinal direction along medial side portion 158. In some cases, plurality of slots 200 may further include third longitudinal slot 283 that extends in a longitudinal direction along lateral side portion 156 and fourth longitudinal slot 284 that extends in a longitudinal direction along medial side portion 158. In this embodiment, first longitudinal slot 281, second longitudinal slot 282, third longitudinal slot 283 and fourth longitudinal slot 284 may intersect slots from first slot set 202. Furthermore, plurality of slots 200 may include second slot set 204 disposed on lower portion 154. In some cases, second slot set 204 may extend in a generally lateral direction on sole structure 110.

In different embodiments, the number of slots comprising plurality of slots 200 can vary. For example, in one embodiment, first slot set 202 can comprise between 1 and 100 slots. In another embodiment, first slot set 202 can comprise between 40 and 70 slots. In still other embodiments, first slot set 202 can include more than 100 slots. In addition, in some embodiments, second slot set 204 can include between 1 and 30 slots. In other embodiments, second slot set 204 can include more than 30 slots. Still further, while plurality of slots 200 comprises four longitudinal slots disposed on medial side portion 158 and lateral side portion 156, in other embodiments, plurality of slots 200 could comprise additional longitudinal slots. In still other embodiments, plurality of slots 200 may not include any longitudinal slots on lateral side portion 156 or medial side portion 158. In still other embodiments, plurality of slots 200 may comprise between 1 and 3 longitudinal slots on lateral side portion 156 and/or medial side portion 158.

In some embodiments, first slot set 202 may not extend through medial lower periphery 168. Likewise, in some cases, first slot set 202 may not extend through lateral lower periphery 164. Additionally, in some embodiments, second slot set 204 may not extend through medial lower periphery 168. Also, second slot set 204 may not extend through lateral lower periphery 164. In other words, medial lower periphery 168 and later lower periphery 164 may be boundaries for first slot set 202 and second slot set 204.

Generally, the arrangement of one or more slots on a sole structure can vary. In some cases, one or more slots may have a linear configuration or shape. In other cases, one or more slots may have a nonlinear configuration or shape. It will be understood that the term "nonlinear configuration" is not intended to be limited to a particular type of nonlinear shape or arrangement. For example, a nonlinear configuration for one or more slots can include smooth nonlinear shapes such as sinusoidal shapes, wavy shapes, as well as other smooth nonlinear shapes. Also, a nonlinear configuration for one or more slots can include polygonal nonlinear shapes with edges such as zig-zag shapes, triangle wave shapes, square wave shapes, as well as any other types of non-smooth nonlinear shapes. Furthermore, in some cases, one or more slots can be associated with a regular nonlinear configuration that includes repeating patterns. In other cases, however, one or more slots can be associated with an irregular nonlinear configuration that does not include repeating patterns. In still other cases, one or more slots can be associated with a nonlinear configuration that includes some portions with repeating patterns and other portions with non-repeating patterns.

In the exemplary embodiment, first slot set 202 may include slots that have a slightly curved shape. In other cases, first slot set 202 may include slots that have a substantially linear shape. Furthermore, in some cases, second slot set 204 may include slots with substantially curved shapes. For example, some slots of second slot set 204 may have arc-like shapes. In some cases, the amount of arcing can decrease as the distance of each slot from midfoot portion 12 increases. In other embodiments, however, any other linear or nonlinear configurations for first slot set 202 and/or second slot set 204 are possible. In addition, in different embodiments, any type of linear or nonlinear configuration can be used for first longitudinal slot 281, second longitudinal slot 282, third longitudinal slot 283 and/or fourth longitudinal slot 284.

In different embodiments, the dimensions of one or more slots of first slot set 202 can vary. In some embodiments, the heights of each slot in first slot set 202 in the generally vertical direction can vary. For example, in one embodiment, slots of first slot set 202 disposed in forefoot portion 10 may be shorter than slots of first slot set 202 disposed in heel portion 14. In other cases, however, the heights of each slot in first slot set 202 can vary in another manner.

Additionally, the widths of each slot in first slot set 202, which may be measured along a generally longitudinal direction, can vary. In some cases, each slot in first slot set 202 can have a substantially similar width. In other cases, two or more slots in first slot set 202 can have substantially different widths.

In some embodiments, the lengths of slots in second slot set 204, as measured in a generally lateral direction on lower portion 154, can vary. In some cases, each slot can have a substantially similar length. In other cases, however, the length of each slot can vary with the width of sole structure 110. For example, in the current embodiment, each slot of second slot set 204 may have a length that is proportional to the width of sole structure 110 in the region associated with the slot.

In some embodiments, the widths of slots in second slot set 204, as measured in a generally longitudinal direction on lower portion 154, can vary. In some cases, each slot can have a substantially similar width. In other cases, however, the width of each slot in second slot set 204 can vary. Furthermore, in some embodiments, the widths of each slot may vary along the length of the slot. For example, in the current embodiment, the widths of each slot in second slot set 204 may be larger towards the center portions of each slot, and narrower at the end portions of each slot. In other embodiments, however, the widths of each slot in second slot set 204 can vary in other manners.

In some embodiments, the lengths of one or more longitudinal slots can vary. In some cases, the length of each longitudinal slot can extend along a substantial length of a sole structure. In other cases, the lengths of each longitudinal slot can be substantially shorter than the length of the sole structure. In addition, each longitudinal slot can have widths that vary. Furthermore, in some cases, the depths of each longitudinal slot can vary.

In some embodiments, slots on different portions of a sole structure can be generally aligned with one another with respect to the longitudinal direction. For example, in some cases, slots on the side portions of a sole structure may be generally aligned with slots on the lower portion of the sole structure. In other words, these slots may be associated with approximately similar longitudinal positions. In other embodiments, however, slots on the side portions may not be aligned with slots on the lower portion. Furthermore, it will be understood that in some embodiments, only some slots may be generally aligned on side portions and lower portions of the sole structure, while other slots may not be aligned.

In some embodiments, one or more slots from first slot set 202 may correspond for one or more slots from second slot set 204. In some cases, some slots of first slot set 202 may be approximately aligned with some slots from second slot set 204. It will be understood that the approximate alignment between some slots refers to an approximately similar location for these slots along the longitudinal direction of article 100. For example, in the current embodiment, first slot 211 and second slot 212, disposed on lateral side portion 156 and medial side portion 158, respectively, may be approximately aligned with third slot 213, which is disposed on lower portion 154. This approximate alignment of first slot 211, second slot 212 and third slot 213 is illustrated in FIGS. 4 and 5, which are discussed in detail below.

In a similar manner, other slots of first slot set 202 may be approximately aligned with slots of second slot set 204. In other embodiments, however, slots of first slot set 202 may not be aligned with slots of second slot set 204. In addition, in some cases, only some slots of first slot set 202 and second slot set 204 may be aligned. In particular, in embodiments where there is a greater number of slots on medial side portion 158 than the number of slots of second slot set 204, it may not be possible to align all of the slots of first slot set 202 located on medial side portion 158 with each of the slots of second slot set 204. Similarly, in embodiments where there is a greater number of slots on lateral side portion 156 than the number of slots of second slot set 204, it may not be possible to align all of the slots of first slot set 202 located on lateral side portion 156 with each of the slots of second slot set 204.

In some embodiments, slots can provide means for decoupling portions of a sole in order to enhance fit, flexibility and stability for an article of footwear. For example, in some cases, slots can be applied to side portions and lower portions of a sole structure to reduce the cross sectional profile of the sole structure at particular regions and to facilitate increased flexibility between various portions of the sole structure. In an exemplary embodiment, slots can be applied to side portions and lower portions to form connecting portions between adjacent portions of the sole structure that articulate with respect to one another.

Figure 4:
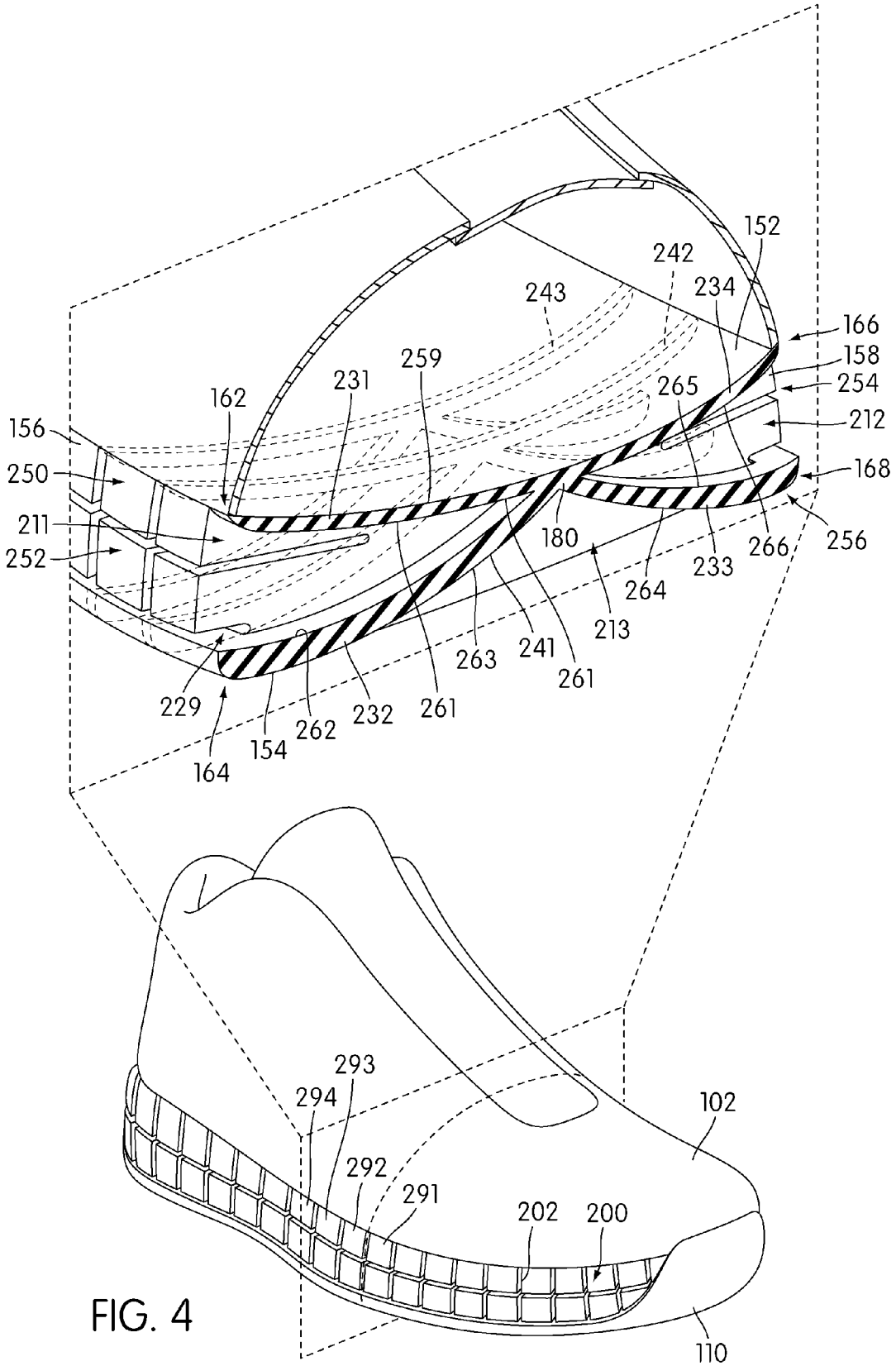
FIG. 4 is an enlarged cut away view of an embodiment of an article of footwear including a plurality of slots.
Figure 5:
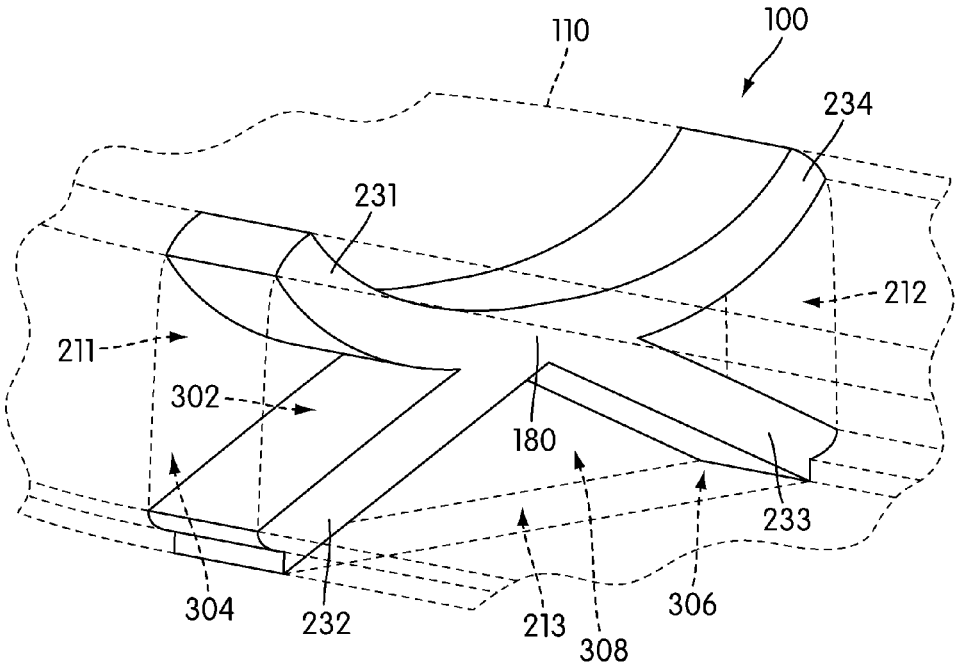
FIG. 5 is an enlarged schematic view of an embodiment of several slots associated with a plurality of connecting portions.

FIG. 4 illustrates an embodiment of a cut away view of a portion of sole structure 110, which is taken at a longitudinal location that approximately corresponds to the locations of first slot 211, second slot 212 and third slot 213. Referring to FIG. 4, first slot 211, second slot 212 and third slot 213 each extend from outer surface 250 of sole structure 110 towards central portion 180 of sole structure 110. For example, first slot 211 extends from outer lateral surface 252 of lateral side portion 156 to central portion 180. Similarly, second slot 212 extends from outer medial surface 254 of medial side portion 158 to central portion 180. Furthermore, third slot 213 extends from outer lower surface 256 of lower portion 154 to central portion 180.

In some embodiments, first slot 211, second slot 212 and third slot 213 may be further associated with one or more connecting portions. The term "connecting portion" as used throughout this detailed description and in the claims, refers to a portion of a sole structure that helps to join adjacent portions of a sole structure that are partially separated by one or more slots in a substantially longitudinal direction. In some cases, two or more connecting portions that are joined together can comprise a connecting member. In an exemplary embodiment, first slot 211, second slot 212 and third slot 213 may be associated with first connecting portion 231, second connecting portion 232, third connecting portion 233 and fourth connecting portion 234.

In some cases, first connecting portion 231 may be a portion of sole structure 110 that bounds a portion of first slot 211. In particular, first connecting portion 231 may bound an upper portion of first slot 211. In some cases, first connecting portion 231 may extend from central portion 180 to lateral upper periphery 162 of sole structure 110. Furthermore, first connecting portion 231 may have an upper surface that corresponds to upper surface 259 of upper portion 152. First connecting portion 231 may also include first inner surface 261 that is associated with an inner surface of first slot 211.

In some embodiments, second connecting portion 232 may be a portion of sole structure 110 that is disposed between first slot 211 and third slot 213. In other words, second connecting portion 232 may bound portions of both first slot 211 and third slot 213. In some cases, second connecting portion 232 may extend from central portion 180 to lateral lower periphery 164. In addition, second connecting portion 232 can include second inner surface 262 that is associated with an inner surface of first slot 211. Also, second connecting portion 232 can include third inner surface 263 that is associated with an inner surface of third slot 213.

In some embodiments, third connecting portion 233 may be a portion of sole structure 110 that is disposed between second slot 212 and third slot 213. In other words, third connecting portion 233 may bound portions of both second slot 212 and third slot 213. In some cases, third connecting portion 233 may extend from central portion 180 to medial lower periphery 168. In addition, third connecting portion 233 can include fourth inner surface 264 that is associated with an inner surface of third slot 213. Also, third connecting portion 233 can include fifth inner surface 265 that is associated with an inner surface of second slot 212.

In some embodiments, fourth connecting portion 234 may be a portion of sole structure 110 that bounds a portion of second slot 212. In particular, fourth connecting portion 234 may bound an upper portion of second slot 212. In some cases, fourth connecting portion 234 may extend from central portion 180 to medial upper periphery 166. Furthermore, fourth connecting portion 234 may have an upper surface that corresponds to upper surface 259 of upper portion 152. Fourth connecting portion 234 may also include sixth inner surface 266 that is associated with an inner surface of second slot 212.

Using this arrangement, first connecting portion 231, second connecting portion 232, third connecting portion 233 and fourth connecting portion 234 can comprise first connecting member 241. In some cases, first connecting member 241 may help connect first sole portion 291 and second sole portion 292, which are partially separated by first slot 211, second slot 212 and third slot 213. In other words, first connecting member 241 may help prevent first sole portion 291 and second sole portion 292 from being completely decoupled.

In some embodiments, other slots of plurality of slots 200 can be aligned in similar manners to form additional hollowed out portions for sole structure 110. These slots can be further associated with connecting members that provide connecting material between adjacent sections of sole structure 110. For example, in some embodiments, first connecting member 241 may be configured to provide connecting material between first sole portion 291 and second sole portion 292. In a similar manner, second connecting member 242, shown in phantom, provides connecting material between second sole portion 292 and third sole portion 293. In a similar manner, third connecting member 243 is configured to provide connecting material between third sole portion 293 and fourth sole portion 294. Likewise, sole structure 110 can include additional hollowed out portions that are formed by slots aligned along side portions and a lower portion of sole structure 110 that form a connected core for sole structure 110. This arrangement allows for some decoupling between adjacent portions in a generally longitudinal direction and can increase the flexibility of sole structure 110, providing enhanced flexibility for a user of article 100. In addition, the partially decoupled portions of sole structure 110 can better conform to the shape of a foot to enhance fit. Still further, the partially decoupled portions can move somewhat independently to adjust to changes in position of article 100, which allows for enhanced stability for a user.

Figure 6:
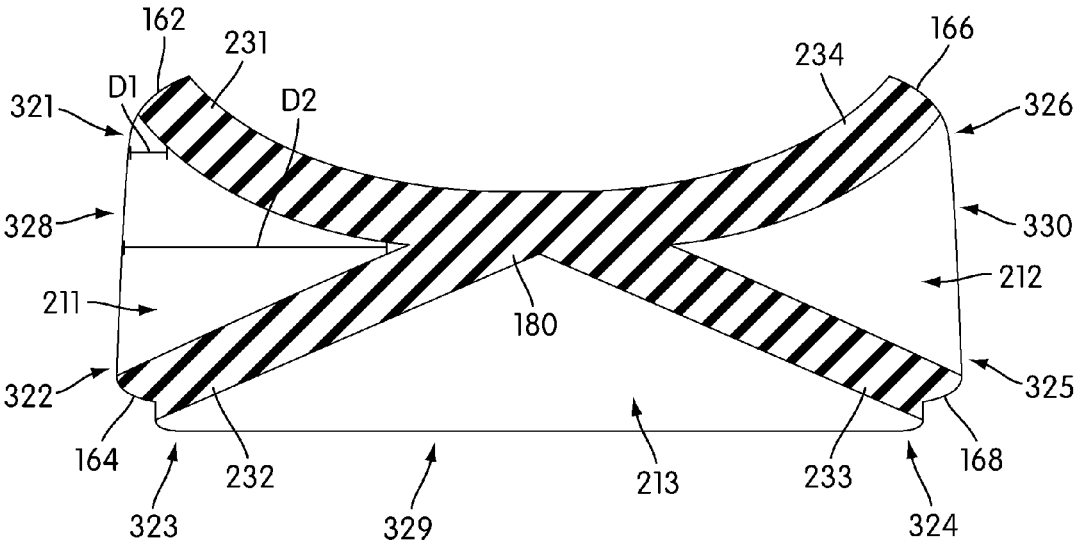
FIG. 6 is a schematic cross-sectional view of an embodiment of a connecting member for a sole structure.

FIGS. 5 and 6 are intended to illustrate details of the configurations of first slot 211, second slot 212 and third slot 213, as well as the configurations of first connecting portion 231, second connecting portion 232, third connecting portion 233 and fourth connecting portion 234. Although these embodiments discuss a particular group of slots and connecting portions associated with hollowed out portion 229, it will be understood that the principles discussed here could be applied to any other group of slots that are aligned in a generally longitudinal direction to create a hollowed out portion, including a plurality of connecting members.

As discussed above, one or more slots on a sole structure can be substantially aligned in a generally longitudinal direction to provide a hollowed out portion for the sole structure. In some embodiments, the front and rear walls of one or more slots may be substantially aligned. For example, in some cases, the front wall of a slot on a lateral side portion of a sole structure can be substantially aligned in a longitudinal direction with a front wall of a slot on a lower portion of the sole structure. Similarly, the rear walls of the slot on the side portion and the slot on the lower portion can be approximately aligned in the longitudinal direction.

FIG. 5 illustrates an embodiment of an enlarged view of a section of article 100 including first slot 211, second slot 212 and third slot 213. In this case, portions of sole structure 110 are shown in phantom, while first connecting portion 231, second connecting portion 232, third connecting portion 233 and fourth connecting portion 234 are illustrated in solid lines. Referring to FIG. 5, first slot 211, second slot 212 and third slot 213 may be approximately aligned in the longitudinal direction, as discussed above. For example, first slot 211 may be associated with first front wall 302 and first rear wall 304, which bound first slot 211 in a generally longitudinal direction. Likewise, third slot 213 may be associated with second front wall 306 and second rear wall 308, which bound third slot 213 in a generally longitudinal direction. In an exemplary embodiment, first front wall 302 and second front wall 306 may be approximately aligned with respect to the longitudinal direction. Likewise, first rear wall 304 and second rear wall 308 may be approximately aligned with respect to the longitudinal direction. In a similar manner, front and rear walls of second slot 212 may be approximately aligned with the front and rear walls of first slot 211 and third slot 213. By aligning corresponding walls of first slot 211, second slot 212 and third slot 213 in the generally longitudinal direction, the overall flexibility between adjacent sole portions of sole structure 110 may be enhanced.

Referring now to FIG. 6, the geometries and orientations of first connecting portion 231, second connecting portion 232, third connecting portion 233 and fourth connecting portion 234 may vary. For example, in the current embodiment, first connecting portion 231 and fourth connecting portion 234 have substantially curved or rounded geometries. In contrast, in the current embodiment, second connecting portion 232 and third connecting portion 233 may have substantially linear geometries. Furthermore, in this embodiment, each connecting portion extends generally from central portion 180 to peripheries, or corners, of sole structure 110. For example, in the current embodiment, first connecting portion 231 extends from central portion 180 to lateral upper periphery 162. Additionally, second connecting portion 232 extends from central portion 180 to lateral lower periphery 164. Also, third connecting portion 233 extends from central portion 180 to medial lower periphery 168. Also, fourth connecting portion 234 extends from central portion 180 to medial upper periphery 166. With this arrangement, first connecting portion 231, second connecting portion 232, third connecting portion 233 and fourth connecting portion 234 may be arranged in an X-like configuration.

In other embodiments, however, each connecting portion can have other geometries. For example, in another embodiment, one or more connecting portions could have an L-like shape or geometry. In still other embodiments, each connecting portion could have any other type of geometry. Furthermore, while the current embodiment illustrates an X-like configuration for the connecting portions, in other embodiments connecting portions could be arranged in other ways. As an example, in another embodiment the connecting portions could be arranged in an I-beam like configuration. Additionally, while first connecting portion 231, second connecting portion 232, third connecting portion 233 and fourth connecting portion 234 are all joined at central portion 180 in the current embodiment, in other embodiments two or more connecting portions could be disjoined. For example, in an alternative embodiment, first connecting portion 231 may be joined to second connecting portion 232, but first connecting portion 231 may not be joined to third connecting portion 233 or fourth connecting portion 234. Likewise, third connecting portion 233 and fourth connecting portion 234 could be joined together, but neither third connecting portion 233 or fourth connecting portion 234 may be joined to first connection portion 231 or second connecting portion 233.

For purposes of discussing the geometry of first slot 211, second slot 212 and third slot 213, each slot can be generally associated with a first end portion, a second end portion and an intermediate portion. In the current embodiment, first slot 211 includes first end portion 321 disposed adjacent to lateral upper periphery 162 and second end portion 322 disposed adjacent to lateral lower periphery 164. First slot 211 also includes first intermediate portion 328 disposed between first end portion 321 and second end portion 322. Third slot 213 includes third end portion 323 disposed adjacent to lateral lower periphery 164 and fourth end portion 324 disposed adjacent to medial lower periphery 168. Third slot 213 also includes second intermediate portion 329 disposed between third end portion 323 and fourth end portion 324. Second slot 212 includes fifth end portion 325 and sixth end portion 326, disposed adjacent to medial lower periphery 168 and medial upper periphery 166, respectively. Second slot 212 also includes third intermediate portion 330 disposed between fifth end portion 325 and sixth end portion 326.

In some embodiments, the geometry of one or more slots can vary. For example, in the current embodiment, first slot 211, second slot 212 and third slot 213 have triangular or wedge-like geometries. In particular, the depth of each slot varies. For example, in one embodiment, first slot 211 may have a depth D1 at first end portion 321. Additionally, first slot 211 may have a depth D2 at first intermediate portion 328. In some cases, depth D1 and depth D2 can have similar values. In other cases, the values of depth D1 and depth D2 can be substantially different. In the exemplary embodiment, depth D1 may have a smaller value than depth D2. In other words, the depth of first slot 211 may increase from first end portion 321 to first intermediate portion 328. Additionally, the depth of first slot 211 may increase between second end portion 322 and first intermediate portion 328. In a similar manner, the depth of second slot 212 may increase between fifth end portion 325 and third intermediate portion 330, as well as between sixth end portion 326 and third intermediate portion 330. Also, the depth of third slot 213 may increase between third end portion 323 and second intermediate portion 329, as well as between fourth end portion 324 and second intermediate portion 329.

In some embodiments, the depths of different slots can change in various ways. In some cases, the depth of first slot 211 may vary in a linear manner between second end portion 322 and first intermediate portion 328. In contrast, the depth of first slot 211 may vary in a nonlinear manner between first end portion 321 and first intermediate portion 328. In a similar way, some other slots of plurality of slots 200 may vary linearly or nonlinearly. For example, in the current embodiment, third slot 213 has a depth that varies in a linear manner between third end portion 323 and second intermediate portion 329 as well as between fourth end portion 324 and second intermediate portion 329. In other embodiments, the depths of one or more slots may be substantially constant. For example, in an alternative embodiment, some slots could have substantially rectangular shapes with constant depths.

By varying the geometries of each slot, including the depths, the flexibility and rigidity of the associated connecting portions can be fine tuned. For example, in the exemplary embodiment, the wedge or triangular shapes of each slot helps to form connecting portions that may easily flex or bend away from one another to allow the upper portion of the sole structure to partially decouple from the lower portion of the sole structure. In particular, in some cases, first connecting portion 231 can be configured to move somewhat independently of second connecting portion 232, which helps to partially decouple lateral upper periphery 162 from lateral lower periphery 164. Likewise, third connecting portion 233 can be configured to move somewhat independently of fourth connecting portion 234, which helps to partially decouple medial upper periphery 166 from medial lower periphery 168. With this arrangement, lower portion 154 of sole structure 110 can remain planted on a ground surface while upper portion 152, which supports a foot, can move somewhat independently to increase overall flexibility, fit and stability.

An article of footwear including slots can be formed in any manner. In some embodiments, a sole structure can be molded in a manner that creates slots in the sloe structure. In other embodiments, slots can be created in a sole structure using any known methods of cutting. For example, in one embodiment, slots can be created using laser cutting techniques. Specifically, in some cases, a laser can be used to remove material from a sole structure in a manner that forms slots in the sole structure. In another embodiment, a hot knife process could be used for forming slots in a sole structure. Examples of methods for forming slots on a sole structure are disclosed in U.S. Patent Application Publication Number 2008/0022553, to McDonald, the entirety of which is hereby incorporated by reference. In other embodiments, however, any other type of cutting method can be used for forming slots. Furthermore, in some cases, two or more different techniques can be used for forming slots. As an example, in another embodiment, slots disposed on a side portion of a sole structure can be formed using laser cutting, while slots on a lower portion of the sole structure could be formed during a molding process. Still further, different types of techniques could be used according to the material used for a sole structure. For example, laser cutting may be used in cases where the sole structure is made of a foam material.

Figure 7:
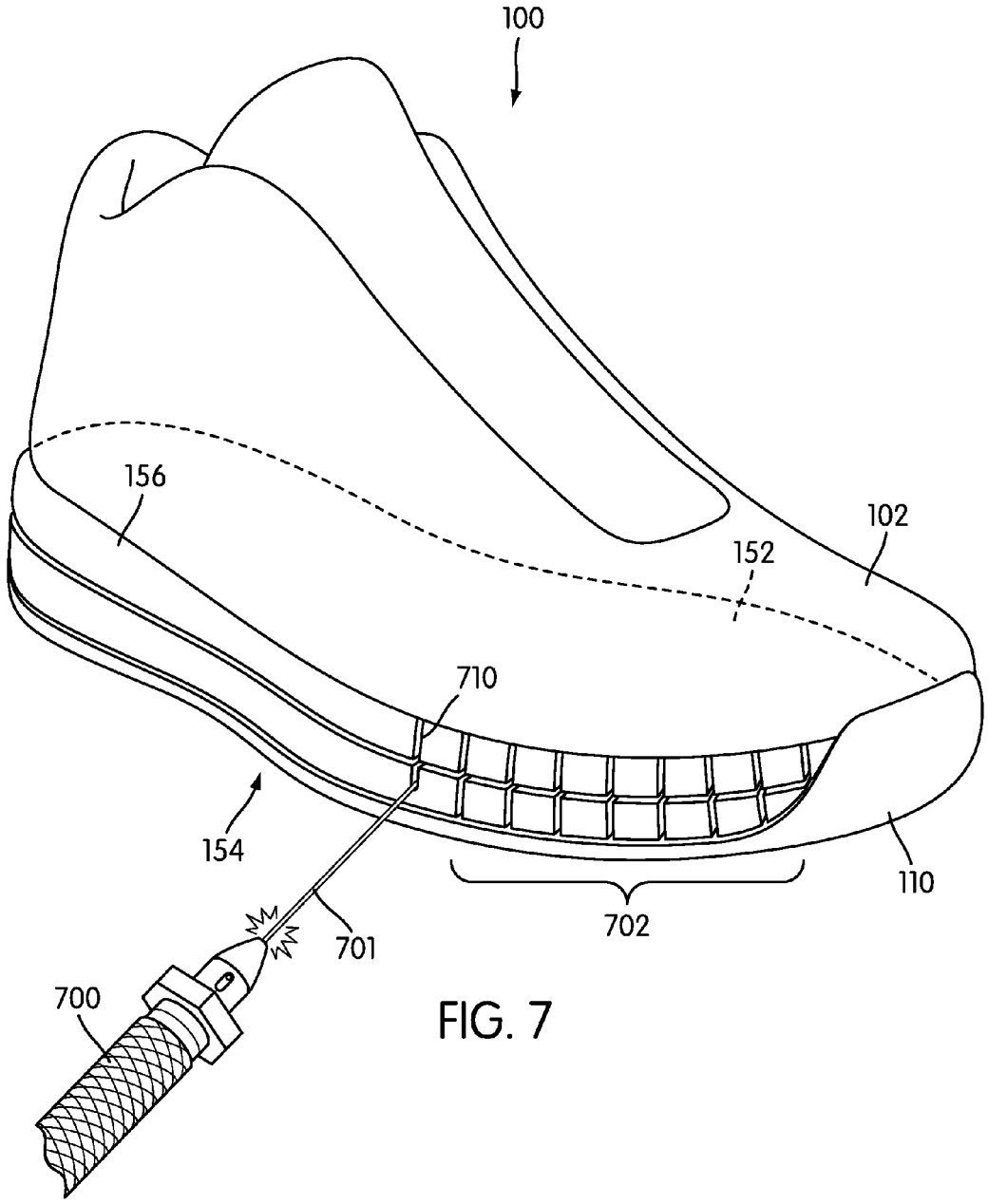
FIG. 7 is an isometric view of an embodiment of a method of forming slots in a sole structure.

FIGS. 7 through 10 illustrate a method of making an article of footwear including a plurality of slots. Referring to FIG. 7, slots can be applied to sole structure 110 using laser 700. In this case, first group of slots 702 has already been formed in lateral side portion 156. At this point, fourth slot 710 is being formed by dragging laser beam 701 between upper portion 152 and lower portion 154 of sole structure 110. Although only slots on lateral side portion 156 are shown in this example, it will be understood that a similar method could be used for creating slots in lower portion 154 as well as in medial side portion 158.

Figure 8:
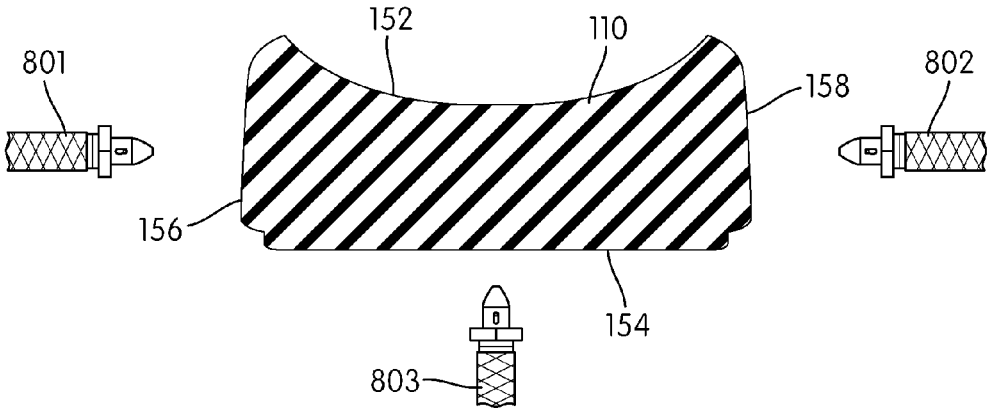
FIG. 8 is a schematic cross-sectional view of an embodiment of a sole structure prior to forming a plurality of slots.
Figure 9:
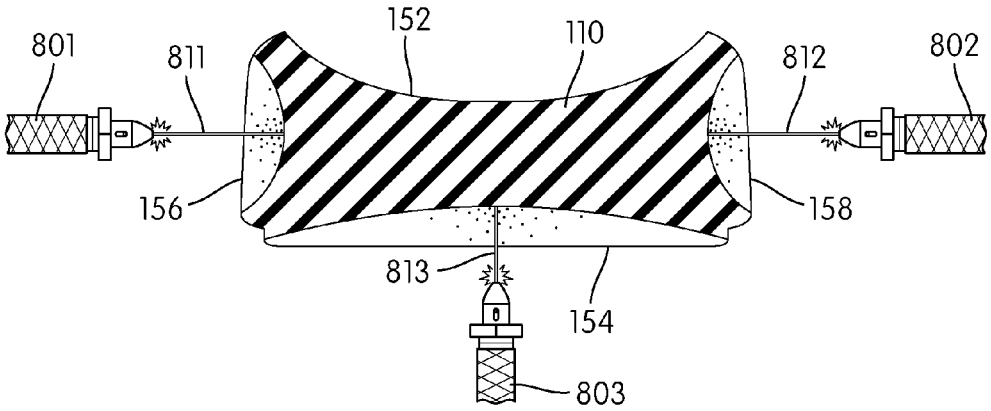
FIG. 9 is a schematic cross-sectional view of an embodiment of a sole structure during a process of forming a plurality of slots.
Figure 10:
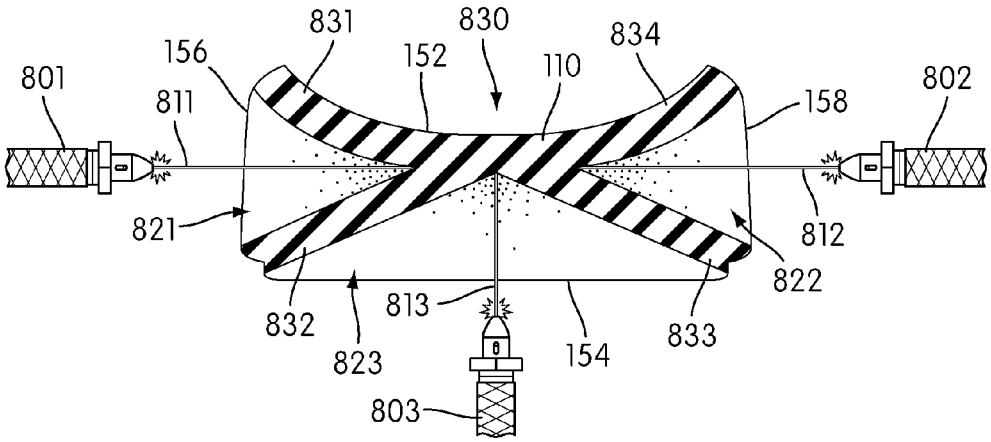
FIG. 10 is a schematic cross-sectional view of an embodiment of a sole structure with a plurality of slots.

Referring to FIGS. 8 through 10, multiple lasers could be used to simultaneously form three longitudinally aligned slots in sole structure 110. During a first step, illustrated in FIG. 8, first laser 801, second laser 802 and third laser 803 may be associated with lateral side portion 156, medial side portion 158 and lower portion 154, respectively. Following this, during a second step that is illustrated in FIG. 9, first laser 801, second laser 802 and third laser 803 may all be turned on so that first beam 811, second beam 812 and third beam 813 begin cutting through sole structure 110. Finally, during a third step that is illustrated in FIG. 10, first laser 801, second laser 802 and third laser 803 may remove material so that first slot 821, second slot 822 and third slot 823 are formed in their entirety. Furthermore, the remaining material after first slot 821, second slot 822 and third slot 823 have been formed may comprise connecting member 830. Connecting member 830 may further include first connecting portion 831, second connecting portion 832, third connecting portion 833 and fourth connecting portion 834.

In some embodiments, the arrangement of slots on a sole structure could be varied to tune properties of the sole structure for specific types of athletic activities. For example, in some cases, the arrangement of slots on a sole structure could be selected according to the type of sport for which the article of footwear is intended. In some embodiments, a manufacturer could vary the arrangement of slots for various types of footwear, including, but not limited to, soccer footwear, running footwear, cross-training footwear, basketball footwear, as well as other types of footwear. Additionally, in other embodiments, the arrangement of slots on a sole structure could be varied according to the gender of the intended user. For example, in some cases, the slots arrangements may vary between footwear for men and footwear for women. Still further, in some embodiments, the arrangement of slots on a sole structure could be varied according to preferences of a user for achieving desired performance effects. As an example, a desire for increased flexibility on a lateral side of the article can be accommodated by increasing the number and/or geometry of slots on the lateral side of the sole structure. In addition, in some embodiments, the configuration of a slots on a sole could be varied to achieve various visual or graphical effects.

Methods of customizing a slot configuration for particular sports, gender and/or personal preferences can be achieved in any manner. In one embodiment, a method of customizing a slot configuration for an article can include provisions for allowing a user to select a customized slot arrangement by interacting with a website that provides customization tools for varying the number and/or geometry of various slots. Examples of different customization systems that can be used for customizing slot configurations are disclosed in U.S. Patent Application Publication Number 2005/0071242, to Allen, and U.S. Patent Application Publication Number 2004/0024645, to Potter et al., the entirety of both being hereby disclosed by reference. It will be understood that the method of customizing slot arrangements for an article of footwear are not limited to use with any particular customization system and in general any type of customization system known in the art could be used.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. In an exemplary embodiment, materials for a sole structure can be selected to enhance the overall flexibility, fit and stability of the article. In one embodiment, a foam material can be used with sole structure, as foam can provide the desired elasticity and strength. In another embodiment, a rubber material could be used to make a midsole of a sole structure. In still another embodiment, a thermoplastic material could be used with a sole structure. For example, in one embodiment, thermoplastic polyurethane (TPU) may be used to make a midsole for a sole structure. In still other embodiments, a sole structure may comprise a multi-density insert that comprises at least two regions of differing densities. For example, in one other embodiment, a midsole of a sole structure could be configured to receive one or more inserts. Examples of different types of inserts that could be used are disclosed in U.S. Patent Application Publication Number 20080244926, to Yu, the entirety of which is hereby incorporated by reference. Also, an upper may be made from any suitable material, including, but not limited to: nylon, natural leather, synthetic leather, natural rubber or synthetic rubber.

An article of footwear can include provisions for adjusting the flexibility characteristics of a sole structure with a plurality of slots. In some embodiments, different materials can be used with different portions of a sole. In an exemplary embodiment, portions of a sole can be filled with fluid to provide additional cushioning and flexibility for a sole structure. For example, in one embodiment, a core portion of a sole structure may comprise a fluid filled member, such as an air bladder. In another embodiment, one or more connecting portions of a sole structure could include hollow cavities capable of receiving fluid.

Figure 11:
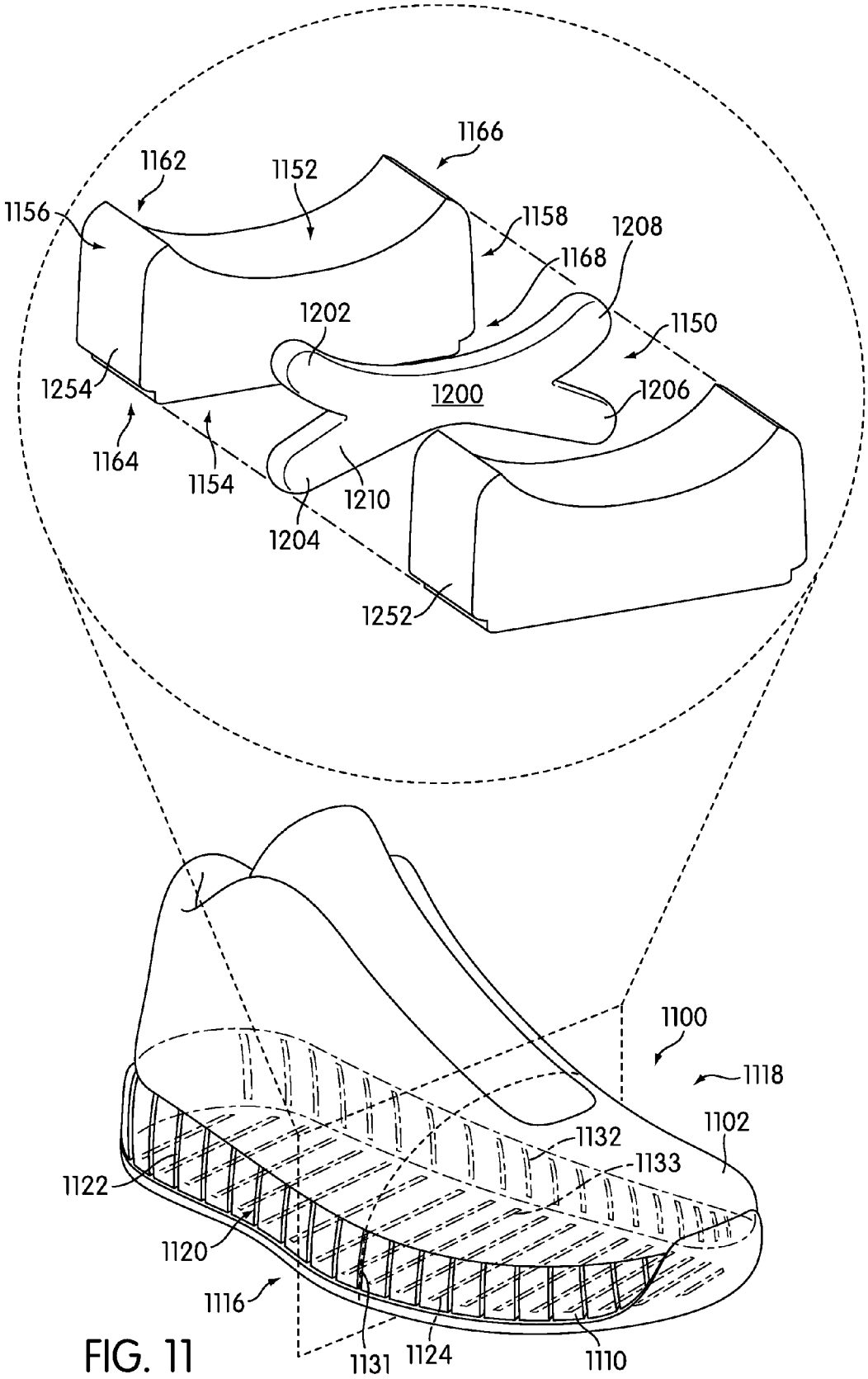
FIG. 11 illustrates an isometric view of an embodiment of an article of footwear with a plurality of slots.
Figure 12:
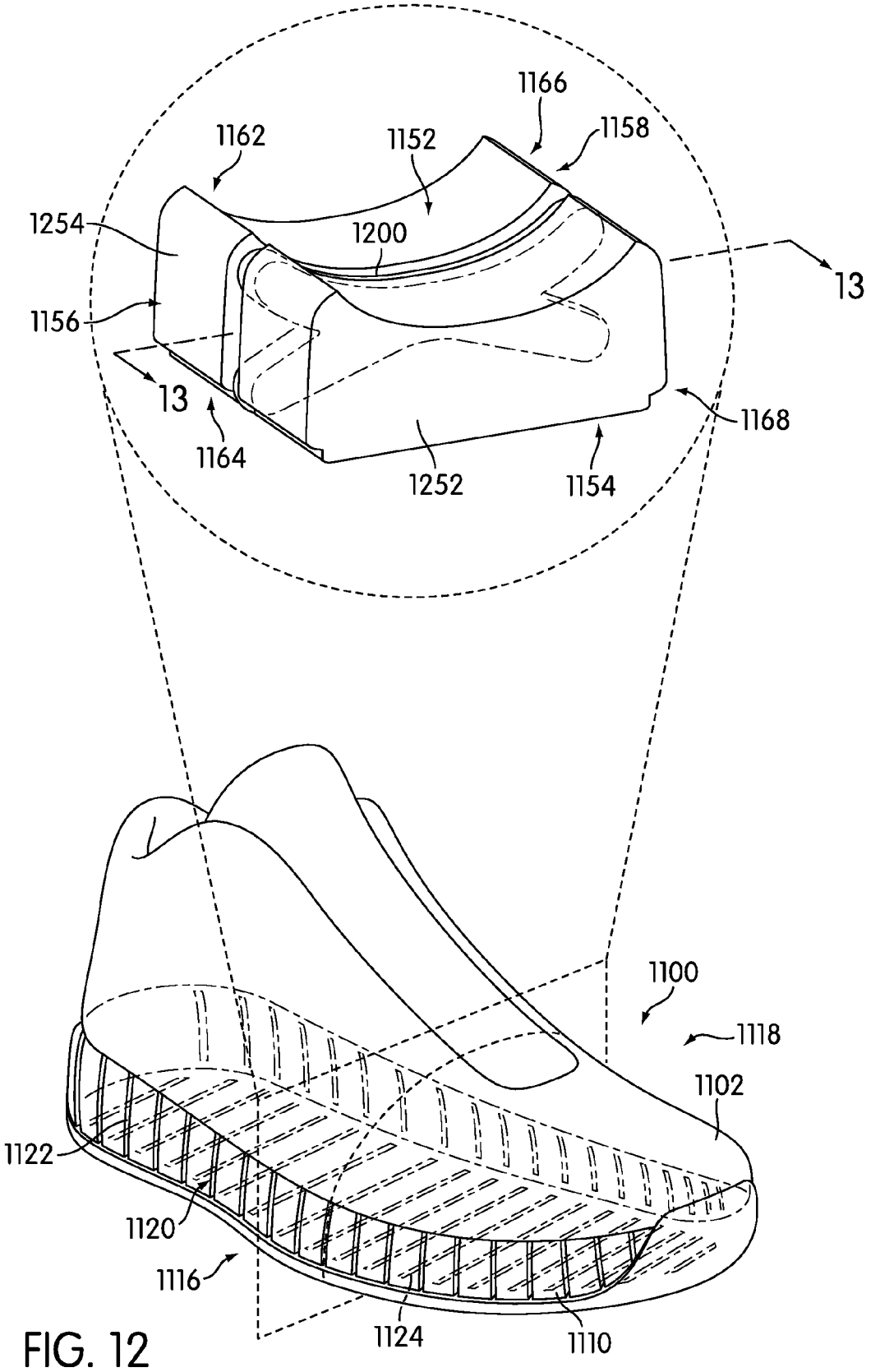
FIG. 12 illustrates an isometric view of an embodiment of an article of footwear with a plurality of slots.
Figure 13:
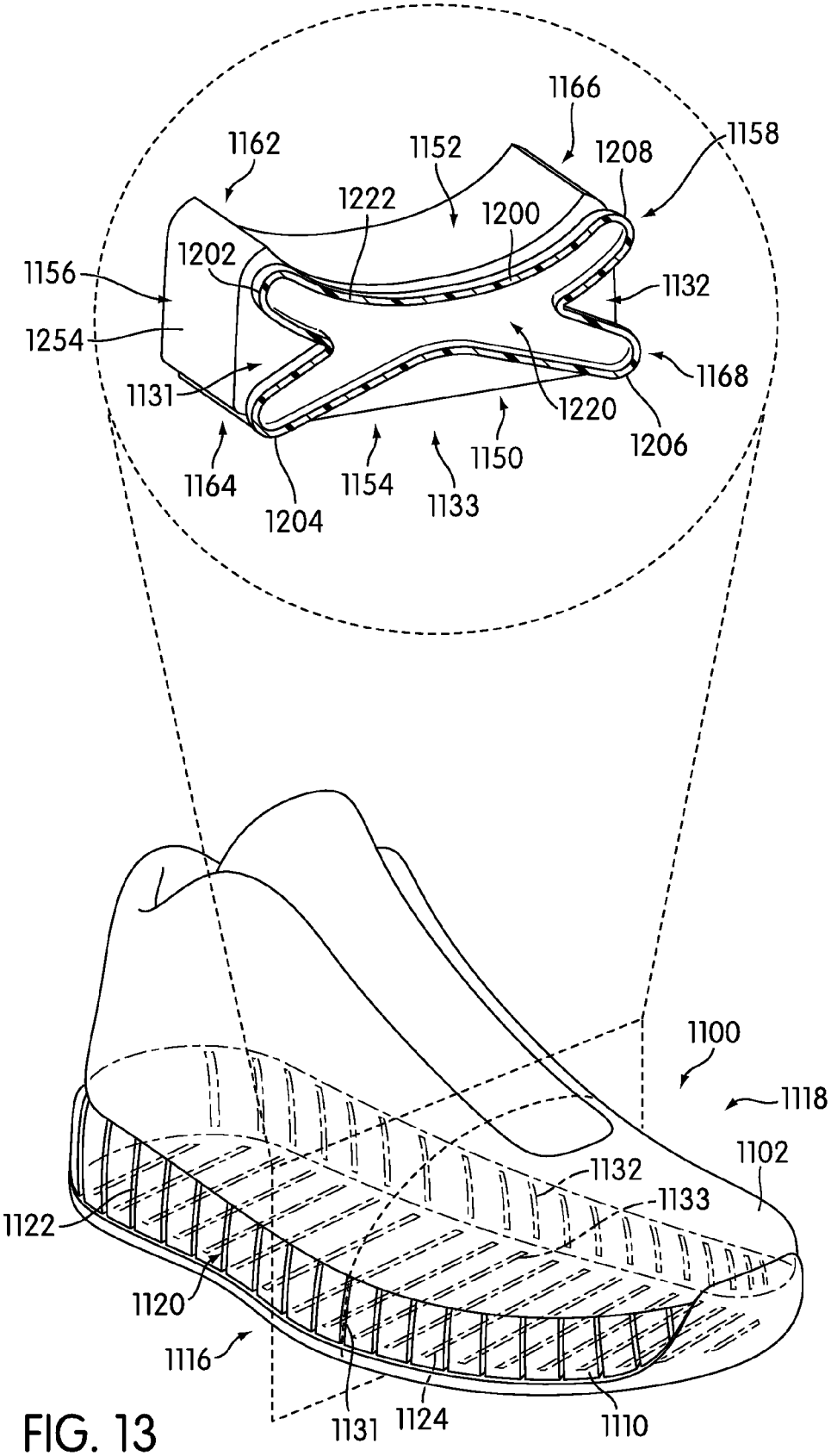
FIG. 13 illustrates an isometric cut away view of an embodiment of a portion of an article of footwear with a plurality of slots.

FIGS. 11 through 13 illustrate an alternative embodiment for an article of footwear. Referring to FIGS. 11 through 13, article of footwear 1100, hereby referred to as article 1100, may be substantially similar to article of footwear 100 discussed above. Article of footwear 1100 can be configured as any type of footwear including, but not limited to: hiking boots, soccer shoes, football shoes, sneakers, rugby shoes, basketball shoes, baseball shoes as well as other kinds of footwear.

Article of footwear 1100 can comprise upper 1102 and sole structure 1110. Sole structure 1110 is secured to upper 1102 and extends between the foot and the ground when article 1100 is worn. In different embodiments, sole structure 1110 may include different components. For example, sole structure 1110 may include an outsole, a midsole, and/or an insole. In some cases, one or more of these components may be optional.

Sole structure 1110 can include upper portion 1152 and lower portion 1154 disposed opposite of upper portion 1152. In some cases, upper portion 1152 can be disposed adjacent to upper 1102. In addition, in some cases, lower portion 1154 can be a ground contacting surface. Sole structure 1110 can further include lateral side portion 1156 and medial side portion 1158. Lateral side portion 1156 may extend between upper portion 1152 and lower portion 1154 on lateral side 1116 of sole structure 1110. Likewise, medial side portion 1158 may extend between upper portion 1152 and lower portion 1154 on medial side 1118 of sole structure 1110.

In some embodiments, sole structure 1110 can include lateral upper periphery 1162 disposed between lateral side portion 1156 and upper portion 1152. Also, sole structure 1110 can include lateral lower periphery 1164 disposed between lateral side portion 1156 and lower portion 1154. Furthermore, sole structure 1110 can include medial upper periphery 1166 disposed between medial side portion 1158 and upper portion 1152. Also, sole structure 1110 can include medial lower periphery 1168 disposed between medial side portion 1158 and lower portion 1154.

In one embodiment, sole structure 1110 can include plurality of slots 1120 for varying the properties of sole structure 1110. Generally, plurality of slots 1120 can comprise various slots arranged in a variety of orientations and in a variety of locations on sole structure 1110. For example, in some embodiments, plurality of slots 1120 may include first slot set 1122 that extend in a generally vertical direction on lateral side portion 1156 and medial side portion 1158. Furthermore, plurality of slots 1120 may also include second slot set 1124 that comprises slots arranged in a generally lateral direction on lower portion 1154 of sole structure 1110. In other words, the arrangement of plurality of slots 1120 may be substantially similar to the arrangement of plurality of slots 200 in the previous embodiments.

Additionally, in some cases, plurality of slots 1120 could include one or more longitudinal slots arranged on lateral side portion 1156 and/or medial side portion 1158. Also, plurality of slots 1120 could include one or more longitudinal slots arranged on lower portion 1154. For purposes of clarity, the current embodiment is shown without any longitudinal slots.

As previously discussed, slots can be approximately aligned with respect to the longitudinal direction. In other words, slots can be arranged with substantially similar longitudinal positions along sole structure 1110. As an example, in the current embodiment, sole structure 1110 includes first slot 1131 disposed on lateral side portion 1156 and second slot 1132 disposed on medial side portion 1158. Additionally, sole structure 1110 includes third slot 1133 disposed on lower portion 1154. In this case, first slot 1131, second slot 1132 and third slot 1133 may be approximately aligned with respect to a longitudinal position on sole structure 1110. In a similar manner, the remaining slots of plurality of slots 1120 may be arranged so that slots on lateral side portion 1156 and medial side portion 1158 are approximately aligned with slots on lower portion 1154.

In some embodiments, first slot 1131, second slot 1132 and third slot 1133 can be associated with hollowed out portion 1150 of sole structure 1110. Hollowed out portion 1150 may extend between first portion 1252 and second portion 1254 of sole structure 1110. In contrast to first portion 1252 and second portion 1254, which have generally rectangular cross-sectional shapes, hollowed out portion 1150 may have an approximately X-like cross-sectional shape in some embodiments. With this arrangement, hollowed out portion 1150 may be associated with a connecting member that extends between first portion 1252 and second portion 1254.

A sole structure can include provisions for modifying the flexibility properties of a connecting member. In some cases, a connecting member could comprise a material that provides increased elasticity between adjacent portions of a sole. In other cases, a connecting member could comprise a fluid filled member that provides increased flexibility. In an exemplary embodiment, a sole structure may comprise a plurality of fluid filled members that act as connecting members between adjacent portions of the sole structure.

In the current embodiment, hollowed out portion 1150 may be associated with fluid filled member 1200. The term "fluid filled member" refers to any member that can be filled with fluid. As an example, fluid filled member 1200 could be any type of fluid filled bladder that is used in footwear for providing cushioning and support. A fluid filled member could be filled with any type of fluid. In some cases, an fluid filled member can be filled with a gas including, but not limited to: air, hydrogen, helium, nitrogen or any other type of gas including a combination of any gases. In other cases, the fluid filled member can be filled with a liquid, such as water or any other type of liquid including a combination of liquids. In an exemplary embodiment, a fluid used to fill a fluid filled member can be selected according to desired properties such as compressibility. For example, in cases where it is desirable for a fluid filled member to be substantially incompressible, a liquid such as water could be used to fill the fluid filled member. Also, in cases where it is desirable for a fluid filled member to be partially compressible, a gas such as air could be used.

Fluid filled member 1200 may have any shape and/or size. In particular, fluid filled member 1200 could have any cross-sectional shape including, but not limited to: rounded shapes, rectangular shapes, polygonal shapes, regular shapes, irregular shapes as well as any other kind of cross-sectional shapes. In one embodiment, fluid filled member 1200 may have an approximately X-like cross-sectional shape.

Fluid filled member 1200 may comprise interior cavity 1220 that is capable of being filled with fluid of some kind. Generally, the shape and size of interior cavity 1220 can be varied. In embodiments where the thickness of outer walls 1222 of fluid filled member 1200 is relatively small, interior cavity 1220 may have a size and shape that is approximately similar to the size and shape of fluid filled member 1200. For example, in the current embodiment, interior cavity 1220 may have an approximately X-like cross-sectional shape that corresponds to the cross-sectional shape of fluid filled member 1200. In other embodiments, however, the shape and size of interior cavity 1220 can be varied by varying the thickness and geometry of outer walls 1222.

Fluid filled member 1200 may be bonded to, or otherwise attached to, first portion 1252 and second portion 1254 of sole structure 1110. In particular, outer surface 1210 of fluid filled member 1200 may be attached to inner surfaces of first portion 1252 and second portion 1254. In other words, fluid filled member 1200 may be used to connect adjacent portions of sole structure 1110.

In some embodiments, fluid filled member 1200 may comprise a plurality of connecting portions that extend outwards from a central portion of fluid filled member 1200.

In this embodiment, fluid filled member 1200 comprises first connecting portion 1202, second connecting portion 1204, third connecting portion 1206 and fourth connection portion 1208, which generally form the arms of the X-like cross-sectional shape. Furthermore, interior cavity 1220 extends through first connecting portion 1221, second connecting portion 1222, third connecting portion 1223 and fourth connecting portion 1224.

Each connecting portion of fluid filled member 1200 may extend to the peripheral corners of sole structure 1110. For example, first connecting portion 1202 may extend to lateral upper periphery 1162 of sole structure 1110. In addition, second connecting portion 1204 may extend to lateral lower periphery 1164. Third connecting portion 1206 may extend to medial lower periphery 1168 and fourth connecting portion 1208 may extend to medial upper periphery 1166. With this arrangement, first slot 1131 may be bounded by first connecting portion 1202 and second connecting portion 1204. Also, second slot 1132 may be bounded by third connecting portion 1206 and fourth connecting portion 1208. Finally, third slot 1133 may be bounded by second connecting portion 1204 and third connecting portion 1206. Moreover, second connecting portion 1204 acts to separate first slot 1131 from third slot 1133, and third connecting portion 1206 acts to separate second slot 1132 from third slot 1133.

With this arrangement, fluid filled member 1200 may provide increased flexibility for sole structure 1110 between first portion 1252 and second portion 1254. In some cases, this combination of slots with a fluid filled member helps provide connecting portions that may easily flex or bend away from one another to allow the upper portion of the sole structure to partially decouple from the lower portion of the sole structure. In particular, in some cases, first connecting portion 1202 can be configured to move somewhat independently of second connecting portion 1204, which helps to partially decouple lateral upper periphery 1162 from lateral lower periphery 1164. Likewise, third connecting portion 1206 can be configured to move somewhat independently of fourth connecting portion 1208, which helps to partially decouple medial upper periphery 1166 from medial lower periphery 1168. With this arrangement, lower portion 1154 of sole structure 1110 can remain planted on a ground surface while upper portion 1152, which supports a foot, can move somewhat independently to increase overall flexibility, fit and stability. Moreover, by using a connecting member with a fluid filled interior cavity, the flexibility of each individual connecting portion can be increased over substantially solid connecting portions. Furthermore, the flexibility of each connecting portion can be varied by changing the type of fluid used and/or the amount of pressure within the interior cavity. This arrangement allows a manufacturer to tune the degree of flexibility provided by a connecting portion according to the type of activities for which the footwear may be used. For example, in articles that may be used for running, a fluid filled member used as a connecting member may be filled with air, which has a high degree of compressibility. In contrast, in articles that may be used for cross training, a fluid filled member may be filled with a liquid such as water, which is not compressible and may therefore provide a greater amount of rigidity.

In some embodiments, other slots of plurality of slots 1120 can be aligned in similar manners to form additional hollowed out portions for sole structure 1110. These slots can be further associated with fluid filled members that act as connecting members between adjacent sections of sole structure 1110. This arrangement allows for some decoupling between adjacent portions of sole structure 1110 and can increase the flexibility of sole structure 1110, providing enhanced flexibility for a user of article 1100. In addition, the partially decoupled portions of sole structure 1110 can better conform to the shape of a foot to enhance fit. Still further, the partially decoupled portions can move somewhat independently to adjust to changes in position of article 1100, which allows for enhanced stability for a user.

It will be understood that the flexibility of a sole structure could be varied by adjusting the properties of one or more fluid filled members. In some embodiments, varying the type of fluid used with a fluid filled member can provide different levels of flexibility as different types of fluids may be associated with different amounts of compression. In other embodiments, varying the geometry of a fluid filled member can provide different levels of flexibility. For example, by shortening the length of one or more connecting portions of a fluid filled member, the flexibility of the connecting portions may be reduced. In still other embodiments, the material properties of a fluid filled member can be varied to tune the flexibility of a sole structure.

An article can include provisions for enhancing the flexibility a central core portion of a sole structure to increase flexibility as well as comfort and fit. In some embodiments, a sole structure can have a central core portion that comprises a partially compressible material. In other embodiments, a sole structure can include a fluid filled member that extends throughout a central core portion of the sole structure.

Figure 14:
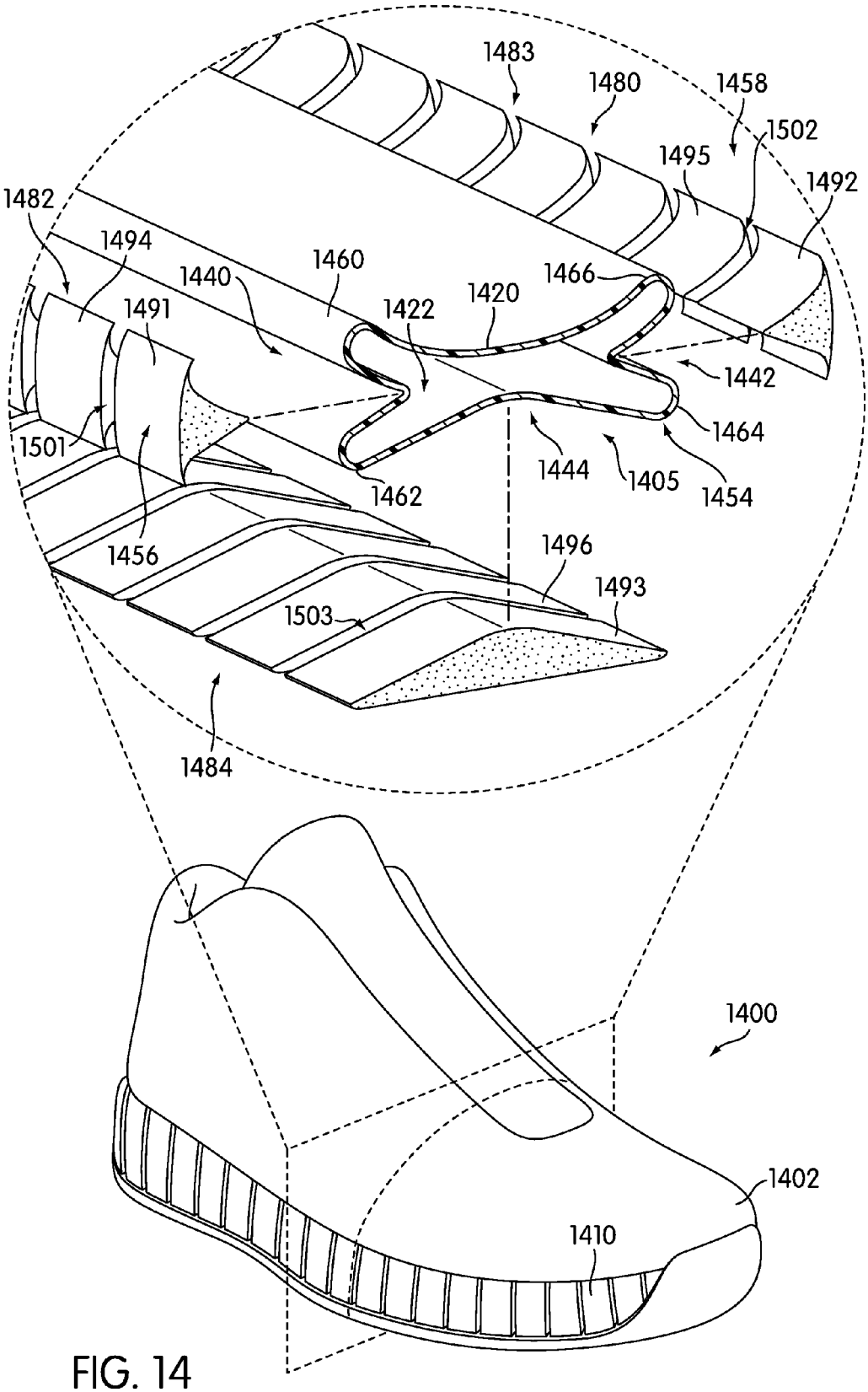
FIG. 14 illustrates an exploded isometric view of an embodiment of an article of footwear with a plurality of slots.
Figure 15:
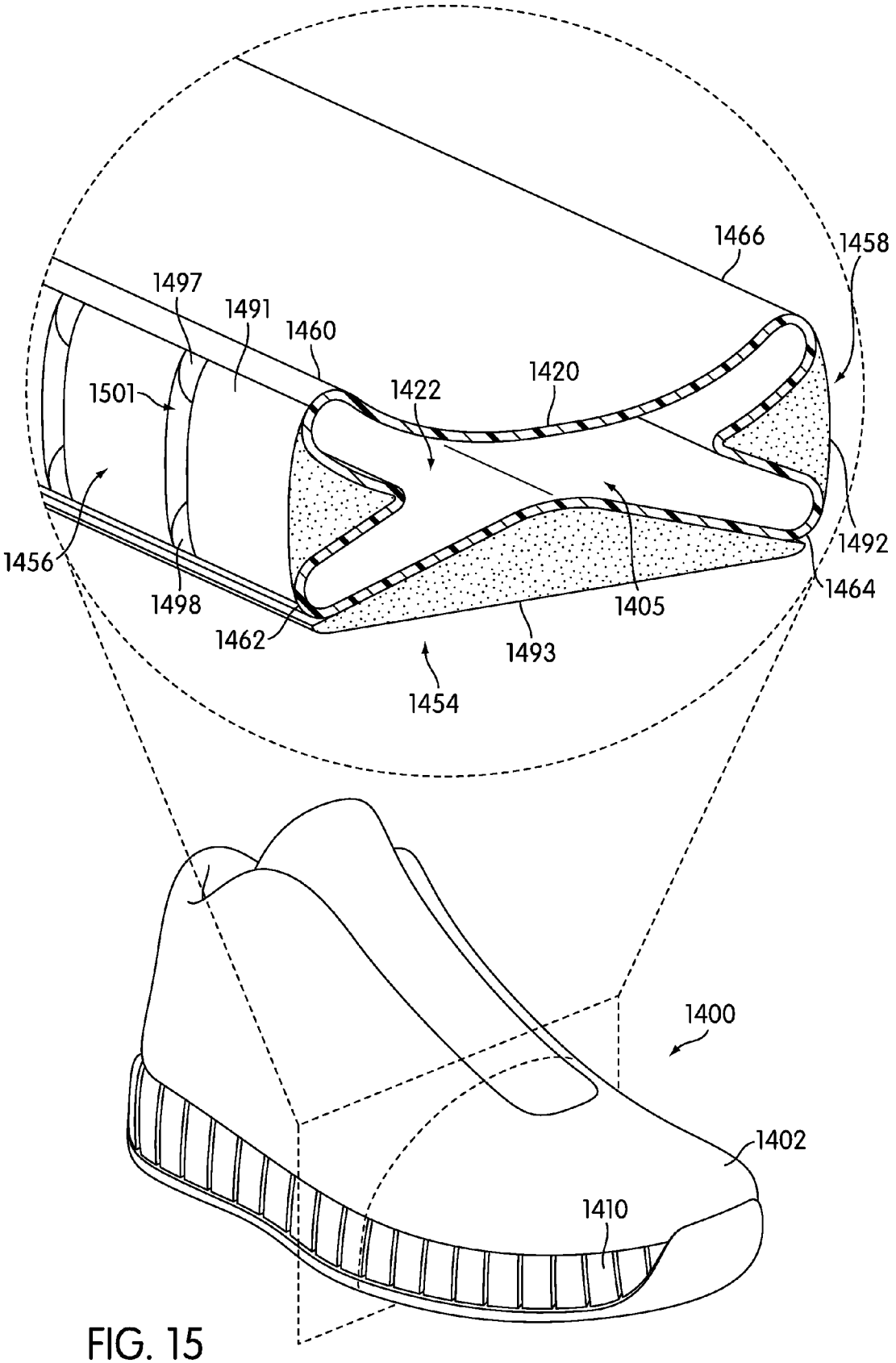
FIG. 15 illustrates an assembled isometric view of an embodiment of an article of footwear with a plurality of slots.

FIGS. 14 and 15 illustrate another embodiment of an article of footwear. Referring to FIGS. 14 and 15, article of footwear 1400 may include sole structure 1410 and upper 1402. Sole structure 1410 may comprise fluid filled member 1420 that extends throughout central core portion 1405 of sole structure 1410 in a substantially longitudinal direction.

Fluid filled member 1420 includes interior cavity 1422 that extends throughout the length of fluid filled member 1420 in a longitudinal direction. Although the current embodiment illustrates a single interior cavity for fluid filled member 1420, other embodiments could include two or more distinct interior cavities. For example, in another embodiment, interior cavity 1422 could be divided into distinct cavities using impermeable walls.

In different embodiments, the geometry of fluid filled member 1420 may vary. In one embodiment, fluid filled member 1420 has a substantially X-like cross-sectional shape. However, in contrast to the previous embodiment, fluid filled member 1420 is elongated in a longitudinal direction. In particular, in some cases, fluid filled member 1420 may extend throughout a substantial entirety of the length of sole structure 1410. In other embodiments, fluid filled member 1420 could have any other cross-sectional shape including, but not limited to: a rectangular shape, a rounded shape, a polygonal shape, a regular shape, an irregular shape as well as any other kind of cross-sectional shape.

Fluid filled member 1420 may be provided with longitudinal channels that extend along the length of fluid filled member 1420. In some cases, fluid filled member 1420 may include lateral channel 1440 disposed on lateral side portion 1456. Lateral channel 1440 may divide lateral side portion 1456 into lateral upper portion 1460 and lateral lower portion 1462. Fluid filled member 1420 may also include medial channel 1442 disposed on medial side portion 1458. Medial channel 1442 may divide medial side portion 1458 into lower medial portion 1464 and upper medial portion 1466. In addition, fluid filled member 1420 may include lower channel 1444 disposed on lower portion 1454. Lower channel 1444 may further divide lower medial portion 1464 and lower lateral portion 1462. These channels may provide fluid filled member 1420 with an X-like cross-sectional shape.

In some cases, sole structure 1410 can include provisions for reinforcing fluid filled member 1420. In some cases, sole structure 1410 can include one or more portions that are configured to fill in one or more channels on fluid filled member 1420. In an exemplary embodiment, sole structure 1410 can be provided with a plurality of segmented portions that help provide increased strength to fluid filled member 1420 by reinforcing lateral side portion 1456, medial side portion 1458 and/or lower portion 1454.

In one embodiment, sole structure 1410 may comprise plurality of segmented portions 1480 that are associated with lateral channel 1440, medial channel 1442 and lower channel 1444. In one embodiment, plurality of segmented portions 1480 may comprise first set of segmented portions 1482 that are associated with lateral channel 1440. Also, plurality of segmented portions 1480 may comprise second set of segmented portions 1483 that are associated with medial channel 1442. Plurality of segmented portions 1480 may also comprise third set of segmented portions 1484 that are associated with lower channel 1444.

Each segmented portion of plurality of segmented portions 1480 may be configured with a shape that corresponds to the shape of an associated channel. For example, first segmented portion 1491 has a shape that approximately matches the shape of lateral channel 1440. This allows first segmented portion 1491 to fit into lateral channel 1440 and form a substantially flat outer sidewall for sole structure 1410. In a similar manner, second segmented portion 1492 has a shape that approximately matches the shape of medial channel 1442. This allows second segmented portion 1492 to fit into medial channel 1442 and form a substantially flat outer sidewall for sole structure 1410. Furthermore, third segmented portion 1493 has a shape that approximately matches the shape of lower channel 1444. This allows third segmented portion 1493 to fit into lower channel 1444 and form a substantially flat lower portion for sole structure 1410. It will be understood that the remaining segmented portions of plurality of segmented portions 1480 each have a shape that approximately matches the shape of a corresponding channel of fluid filled member 1420. With this arrangement, plurality of segmented portions 1480 may reinforce lateral side portion 1456, medial side portion 1458 and lower portion 1454. In addition, in some cases, plurality of segmented portions 1480 may provide a substantially smooth outer surface for lateral side portion 1456, medial side portion 1458 and lower portion 1454 of sole structure 1410.

In the current embodiment, each segmented portion has an approximately triangular cross-sectional shape that corresponds to the approximately triangular cross-sectional shapes of lateral channel 1440, medial channel 1442 and lower channel 1444. However, in other embodiments, each segmented portion could have any other cross-sectional shape. In some cases, the cross-sectional shape of a segmented portion may be selected according to the shape of a longitudinal channel disposed in a fluid member. For example, in another embodiment with rounded channels, a plurality of segmented portions could have approximately rounded cross-sectional shapes.

In some embodiments, adjacent segmented portions may be separated by slots. For example, in the current embodiment, first segmented portion 1491 is separated from fourth segmented portion 1494 on lateral side portion 1456 by first slot 1501. In a similar manner, second segmented portion 1492 is separated from fifth segmented portion 1495 on medial side portion 1458 by second slot 1502. Still further, third segmented portion 1493 is separated from sixth segmented portion 1496 on lower portion 1454 by third slot 1503. Similarly, other adjacent segmented portions of plurality of segmented portions 1480 are separated by slots on lateral side portion 1456, medial side portion 1458 and lower portion 1454. This arrangement provides a slotted arrangement for lateral side portion 1456, medial side portion 1458 and lower portion 1454 that is similar to the slotted arrangements disclosed in the previous embodiments. Moreover, the slots may be aligned in an approximately longitudinal direction. For example, first slot 1501, second slot 1502 and third slot 1503 may be approximately aligned in a longitudinal direction on sole structure 1410.

By providing a slotted arrangement on lateral side portion 1456, medial side portion 1458 and lower portion 1454, adjacent regions of sole structure 1410 may be partially decoupled. In some cases, slots provided on lateral side portion 1456 may allow for some partial decoupling between lateral upper portion 1460 and lateral lower portion 1462. For example, in the current embodiment, first portion 1497 of fluid filled member 1420 may be configured to move somewhat independently from second portion 1498 of fluid filled member 1420 due to the presence of first slot 1501. Similarly, slots provided on medial side portion 1458 may allow for some partial decoupling between upper medial portion 1466 and lower medial portion 1464. In a similar manner, slots provided on lower portion 1454 may allow for some partial decoupling between lower lateral portion 1462 and lower medial portion 1464. This arrangement helps to increase the flexibility of sole structure 1410 in order to enhance flexibility, fit and comfort for a user.

In some embodiments, segmented portions can be made of a substantially similar material to a fluid filled member. As an example, in one embodiment, segmented portions and a fluid filled member could both be made of a plastic material such as TPU. In other embodiments, segmented portions can be made of a substantially different material from a fluid filled member. For example, in one embodiment, a fluid filled member may be made of a plastic material while the segmented portions could comprise a foam material. In another embodiment, a fluid filled member could be made of a microlayer and the segmented portions could comprise a TPU material. Examples of microlayers are disclosed in U.S. Pat. Nos. 6,082,025 and 6,127,026 to Bonk et al., both hereby incorporated by reference. Moreover, in some cases, different segmented portions of a sole structure could comprise various different materials.

It will also be understood that in other embodiments, a plurality of segmented portions could be partially connected to one another. For example, in some cases, a plurality of segmented portions may comprise a single piece of material that fills a corresponding channel within a fluid filled member. In such an embodiment, slots could be provided through portions of the material that do not completely separate adjacent portions.

Figure 16:
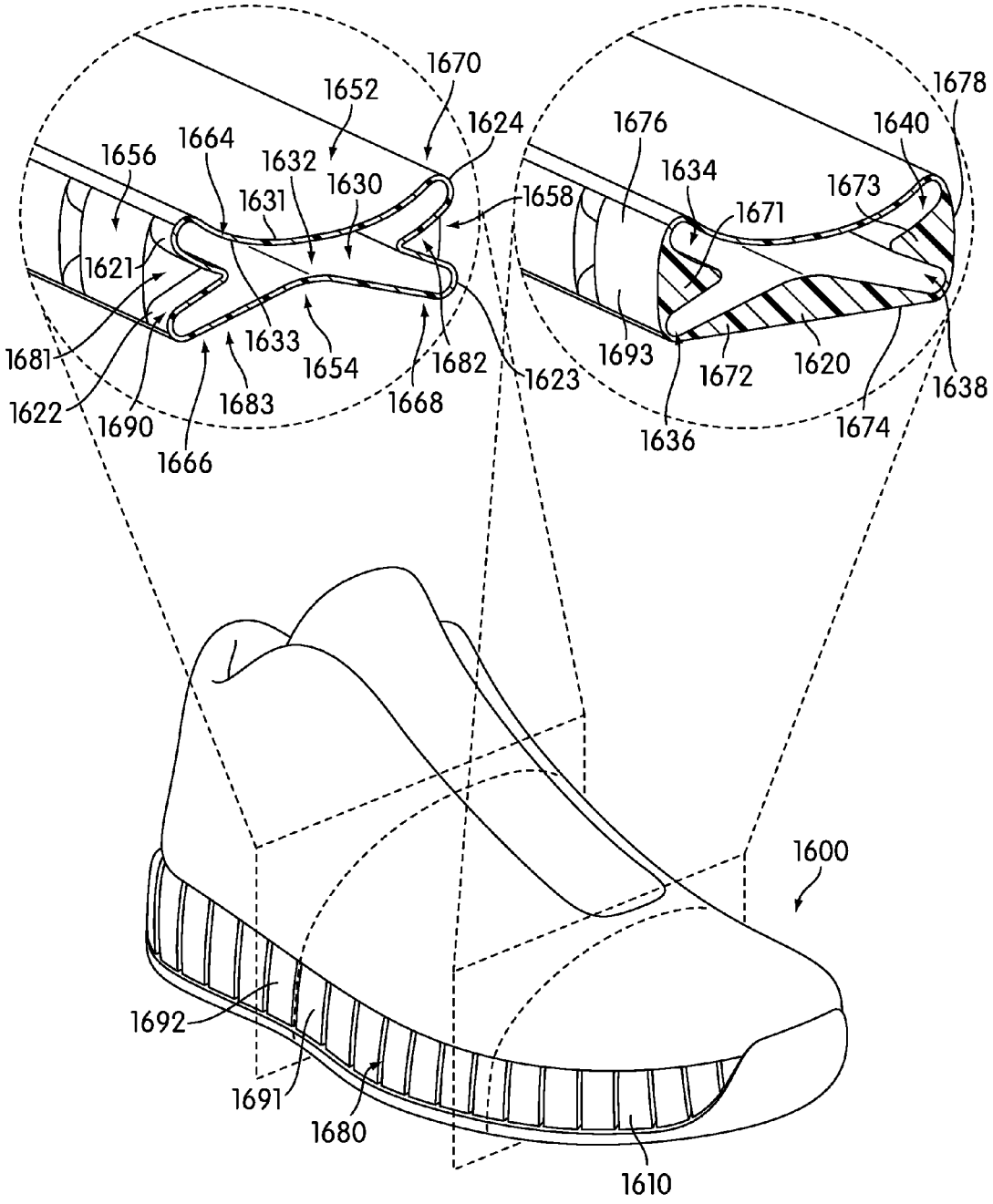
FIG. 16 illustrates an isometric view of an embodiment of an article of footwear with a plurality of slots.

A fluid filled member may include provisions for receiving slots. In some embodiments, a fluid filled member can be provided with thickened portions that can accommodate slots. Referring to FIG. 16, which illustrates another embodiment of an article of footwear, article 1600 may include sole structure 1610. In this embodiment, sole structure 1610 comprises a fluid filled member 1620. In this case, fluid filled member 1620 is bounded by upper portion 1652, lower portion 1654, lateral side portion 1656 and medial side portion 1658. In addition, lateral side portion 1656 includes a substantially flat lateral outer surface 1676. Medial side portion 1658 includes a substantially flat medial outer surface 1678. Also, lower portion 1654 includes a substantially flat lower outer surface 1674.

Fluid filled member 1620 may also include interior cavity 1630. In this case, interior cavity 1630 may have a substantially X-like cross-sectional shape. In particular, interior cavity 1630 may comprise central cavity portion 1632, lateral upper cavity portion 1634, lateral lower cavity portion 1636, medial lower cavity portion 1638 and medial upper cavity portion 1640.

Fluid filled member 1620 may comprise thickened portions that extend between portions of interior cavity 1630. For example, in the current embodiment, fluid filled member 1620 may include first thickened portion 1671 that extends between lateral upper cavity portion 1634 and lateral lower cavity portion 1666. Additionally, fluid filled member 1620 may include second thickened portion 1672 that extends between lateral lower cavity portion 1666 and medial lower cavity portion 1668. Furthermore, in some cases, fluid filled member 1620 may include third thickened portion 1673 that extends between medial lower cavity portion 1668 and medial upper cavity portion 1670. These thickened portions may enlarge the overall cross-sectional shape of fluid filled member 1620 and provide enhanced structural support.

Fluid filled member 1620 may comprise plurality of slots 1680. In some cases, plurality of slots 1680 can comprise slots that are oriented in an approximately vertical direction on lateral side portion 1656 and medial side portion 1658. In addition, plurality of slots 1680 could comprise slots oriented in an approximately lateral direction on lower portion 1654. In some cases, plurality of slots 1680 may be provided on thickened portions of fluid filled member 1620.

For example, in the current embodiment, plurality of slots includes first slot 1681, second slot 1682 and third slot 1683 disposed on lateral side portion 1656, medial side portion 1658 and lower portion 1654, respectively. This arrangement forms a generally hollowed out portion 1690 that is disposed between first portion 1691 and second portion 1692. In addition, as previously discussed, first slot 1681, second slot 1682 and third slot 1683 may be substantially aligned with respect to the longitudinal direction.

In some embodiments, fluid filled member 1620 may comprise a plurality of connecting portions that are associated with hollowed out portion 1690. In this embodiment, fluid filled member 1620 comprises first connecting portion 1621, second connecting portion 1622, third connecting portion 1623 and fourth connection portion 1624, which generally form the arms of the X-like cross-sectional shape.

Each connecting portion of fluid filled member 1620 may extend to the peripheral corners of sole structure 1610. For example, first connecting portion 1621 may extend to lateral upper periphery 1664 of sole structure 1610. In addition, second connecting portion 1622 may extend to lateral lower periphery 1666. Third connecting portion 1623 may extend to medial lower periphery 1668 and fourth connecting portion 1624 may extend to medial upper periphery 1670. With this arrangement, first slot 1681 may be bounded by first connecting portion 1621 and second connecting portion 1622. Also, second slot 1682 may be bounded by third connecting portion 1623 and fourth connecting portion 1624. Finally, third slot 1683 may be bounded by second connecting portion 1622 and third connecting portion 1623. Moreover, second connecting portion 1622 acts to separate first slot 1681 from third slot 1683 and third connecting portion 1623 acts to separate second slot 1682 from third slot 1683.

With this arrangement, fluid filled member 1620 may provide increased flexibility for sole structure between first portion 1691 and second portion 1692. In some cases, this combination of slots with a fluid filled member helps provide connecting portions that may easily flex or bend away from one another to allow the upper portion of the sole structure to partially decouple from the lower portion of the sole structure. In particular, in some cases, first connecting portion 1621 can be configured to move somewhat independently of second connecting portion 1622, which helps to partially decouple lateral upper periphery 1664 from lateral lower periphery 1666. Likewise, third connecting portion 1623 can be configured to move somewhat independently of fourth connecting portion 1624, which helps to partially decouple medial upper periphery 1670 from medial lower periphery 1668. With this arrangement, lower portion 1654 of sole structure 1610 can remain planted on a ground surface while upper portion 1652, which supports a foot, can move somewhat independently to increase overall flexibility, fit and stability. Moreover, by using a connecting member with a fluid filled interior cavity, the flexibility of each individual connecting portion can be increased over substantially solid connecting portions. Furthermore, the flexibility of each connecting portion can be varied by changing the type of fluid used and/or the amount of pressure within the interior cavity. This arrangement allows a manufacturer to tune the degree of flexibility provided by a connecting portion according to the type of activities for which the footwear may be used.

This arrangement provides a reduced cross-sectional shape for hollowed out portion 1690. For example, hollowed out portion 1690 has a cross-sectional area that is substantially less than the cross-sectional area of third portion 1693 of fluid filled member 1620. In some cases, hollowed out portion 1690 may have a substantially X-like cross-sectional area, while third portion 1693 may have an approximately rectangular cross-sectional area. Moreover, in some cases, the cross-sectional area of hollowed out portion 1690 may be substantially similar to the cross-sectional area of interior cavity 1630. In particular, outer wall 1631 of fluid filled member 1620 may have a contoured shape that approximately corresponds to the shape of inner wall 1633 which bounds interior cavity 1630. This arrangement may help increase flexibility at hollowed out portion 1690.

It will be understood that a similar configuration can be used for a plurality of hollowed out portions disposed throughout sole structure 1610. In particular, slots may be provided to form hollowed out portions with connecting portions that can be partially decoupled to increase flexibility at the hollowed out portions.

An article can include provisions for modifying the flexibility of a sole structure comprising a fluid filled member. In some embodiments, the flexibility of a fluid filled member could be modified by varying the geometry of an internal cavity. For example, in some cases, the cross-sectional shape of an internal cavity could be varied.

Figure 17:
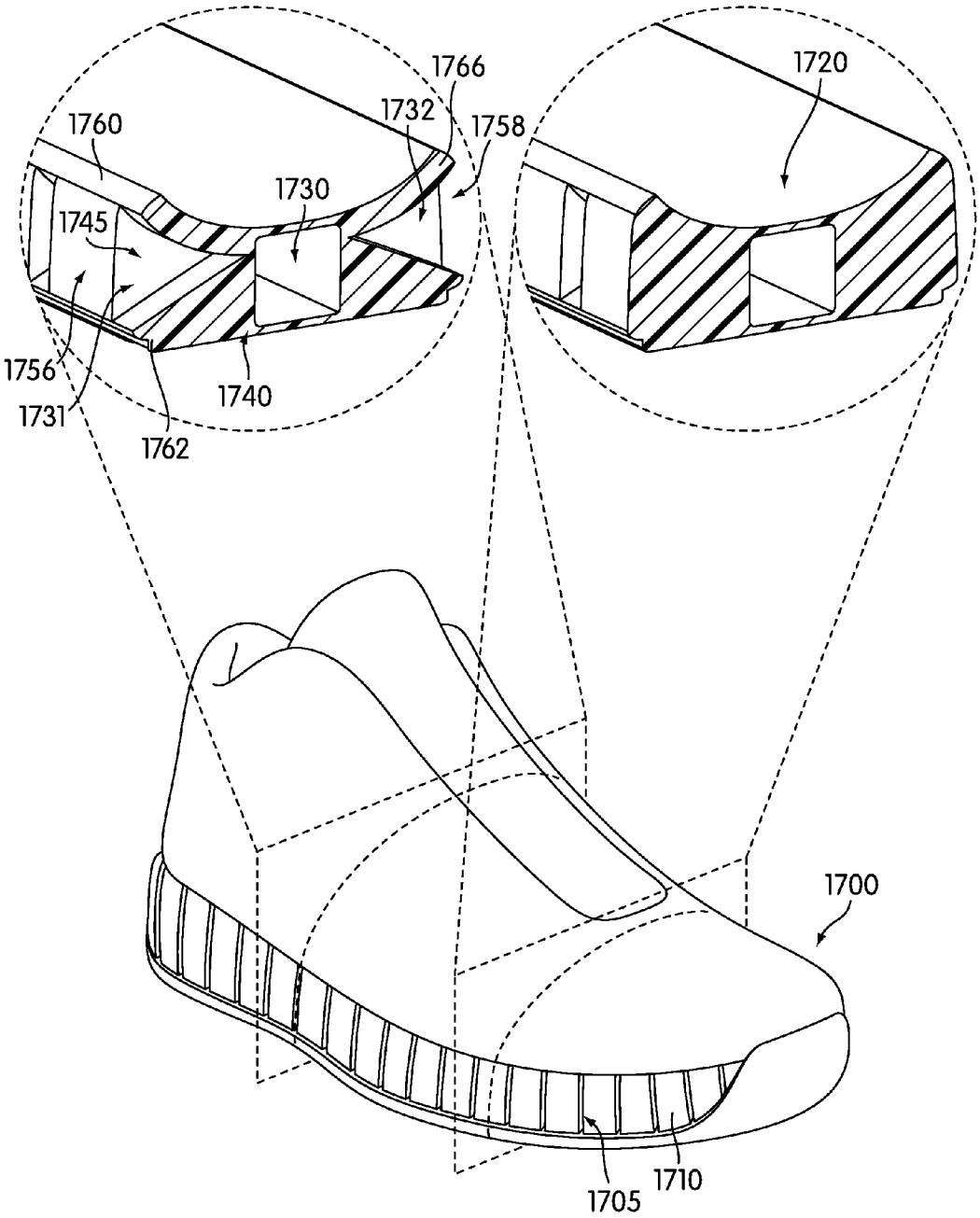
FIG. 17 illustrates an isometric view of an embodiment of an article of footwear with a plurality of slots.

FIG. 17 illustrates another embodiment of an article of footwear. Referring to FIG. 17, article of footwear 1700 comprises sole structure 1710 that is formed using fluid filled member 1720. Fluid filled member 1720 could be any type of fluid filled member.

In the current embodiment, fluid filled member 1720 includes internal cavity 1730. In this case, internal cavity 1730 has a substantially rectangular cross-sectional shape and extends throughout a substantial majority of the length of sole structure 1710. In contrast to the previous embodiments, internal cavity 1730 is generally confined to central portion 1740 of fluid filled member 1720, which is disposed between lateral side portion 1756 and medial side portion 1758.

Fluid filled member 1720 may also include plurality of slots 1705 that are disposed on lateral side portion 1756 and medial side portion 1758. In this case, plurality of slots 1705 may comprise pairs of slots arranged on lateral side portion 1756 and medial side portion 1758 that are generally aligned in a longitudinal direction. For example, in this embodiment, first slot 1731 and second slot 1732 are disposed on lateral side portion 1756 and medial side portion 1758, respectively and generally form hollowed out portion 1745. In this case, first slot 1731 and second slot 1732 have substantially triangular cross-sectional shapes, however in other embodiments the cross-sectional shapes of first slot 1731 and second slot 1732 could vary. This arrangement helps provide some decoupling between lateral upper portion 1760 and lateral lower portion 1762 as well as between medial upper portion 1766 and medial lower portion 1764.

In some embodiments, interior cavity 1730 may be disposed between first slot 1731 and second slot 1732. With this arrangement, compression of central portion 1740 of sole structure 1710 may be controlled by interior cavity 1730, while the decoupling of the side portions of sole structure 1710 may be controlled using plurality of slots 1705. Therefore, by varying the characteristics of interior cavity 1730 and the characteristics of plurality of slots 1705, the overall flexibility of sole structure 1710 can be fine-tuned to achieve maximum comfort and fit for a user.

An article can include provisions for varying flexibility throughout different portions of a sole. In embodiments including a fluid filled member, the fluid filled member can have walls of varying thicknesses. For example, in one embodiment, a medial side portion of a fluid filled member could be substantially thicker than a lateral side portion to provide varying amounts of flexibility on the medial side and the lateral side of the sole structure. In another embodiment, a lateral side portion could be thicker than a medial side portion. In still another embodiment, a lower portion could have a greater thickness than a medial side portion and/or a lateral side portion.

Figure 18:
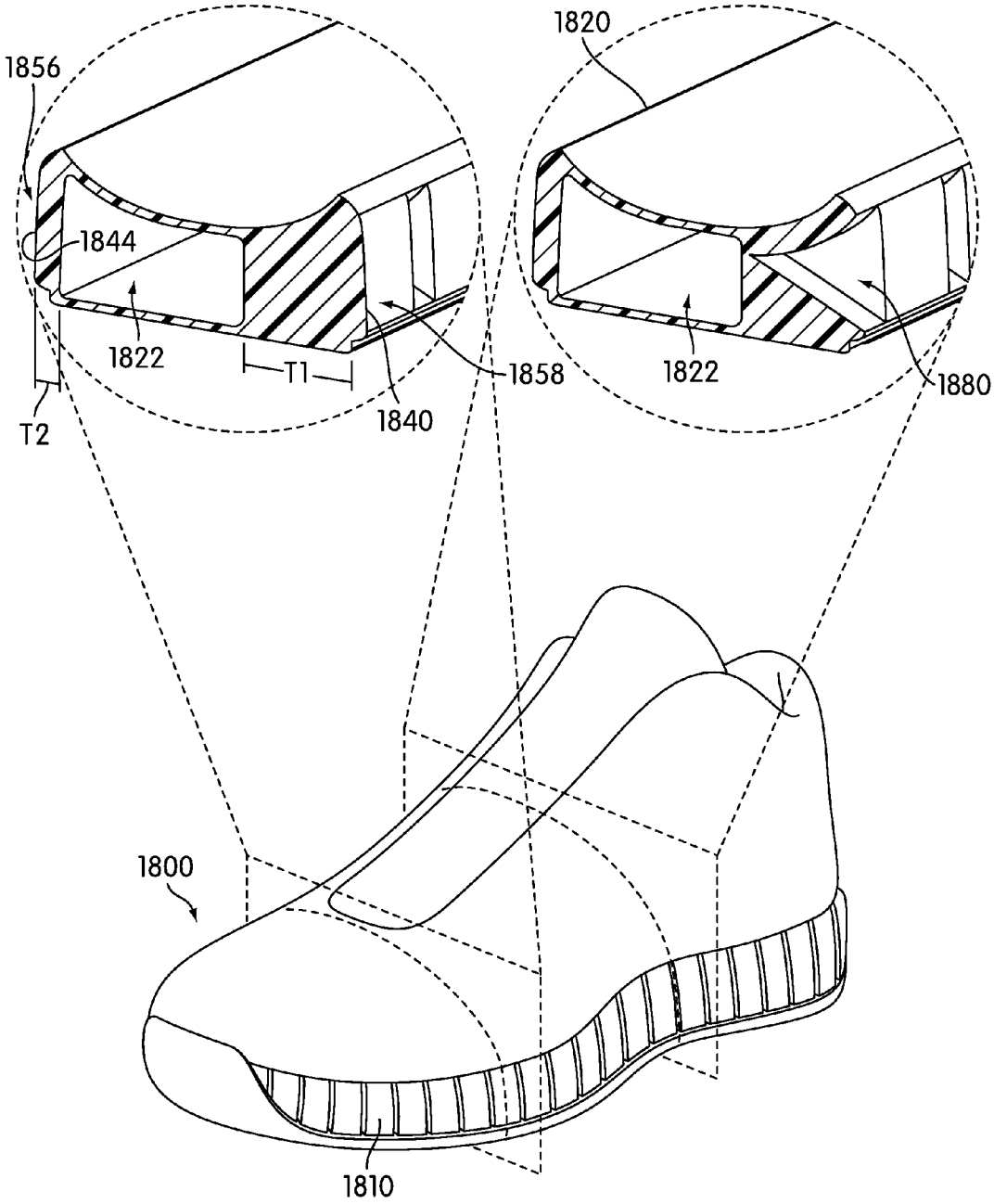
FIG. 18 illustrates an isometric view of an embodiment of an article of footwear with a plurality of slots.

FIG. 18 illustrates another embodiment of an article of footwear. Referring to FIG. 18, article of footwear 1800 comprises sole structure 1810. Sole structure 1810 may comprise fluid filled member 1820 that includes internal cavity 1822 capable of receiving various kinds of fluids.

Fluid filled member 1820 may comprise lateral side portion 1856 and medial side portion 1858, which may have varying thicknesses. For example, in this embodiment, medial side portion 1858 has thickness T1, measured from outer medial surface 1840 to a medial side of interior cavity 1822. In contrast, lateral side portion 1856 has thickness T2, measured from outer lateral surface 1844 to a lateral side of interior cavity 1822, which is substantially less than thickness T1.

In the current embodiment, plurality of slots 1880 are provided on medial side portion 1858 since medial side portion 1858 is thick enough to accommodate slots. However, lateral side portion 1856 does not include any slots, due to the relatively narrow thickness of lateral side portion 1856. With this arrangement, medial side portion 1858 can be made thicker than lateral side portion 1856 to help prevent pronation, while plurality of slots 1880 may provide for some increases in flexibility.

Although the current embodiment includes a thicker medial portion, in other embodiments any other portions of a fluid filled member could be thickened to enhance strength and/or stability. For example, in another embodiment, a lateral side portion could be thicker than a medial side portion. In still another embodiment, a lower portion could be thicker than either a medial side portion or a lateral side portion. By varying the thicknesses of the medial, lateral, lower and upper portions of a fluid filled member and providing slots in the thickened portions, a sole structure can be provided with an optimum balance of stability and flexibility.

A fluid filled member can be made of various materials in different embodiments. In some embodiments, a fluid filled member can be made of a substantially flexible and resilient material that is configured to deform under fluid forces. In some cases, a fluid filled member can be made of a plastic material. Examples of plastic materials that may be used include high density polyvinyl-chloride (PVC), polyethylene, thermoplastic materials, elastomeric materials as well as any other types of plastic materials including combinations of various materials. In embodiments where thermoplastic polymers are used for a fluid filled member, a variety of thermoplastic polymer materials may be utilized for the fluid filled member, including polyurethane, polyester, polyester polyurethane, and polyether polyurethane. Another suitable material for a fluid filled member is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A fluid filled member may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Nitrogen blocking barrier materials may also be utilized and include PVDC, also known as SURAN; nylon; EVOH; and PVDF, also known as KYNAR. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

Slots can be applied to a sole structure including a fluid filled member in any manner. In some cases, a fluid filled member can be constructed with thickened portions from which material can be removed. Slots may be formed in the thickened portions using laser cutting or a hot knife process, as discussed in detail above. Slots can also be formed in the thickened portions in any other manner. In other cases, a sole structure can be manufactured by assembling a fluid filled member with a supporting member that includes pre-formed slots.

Figure 19:
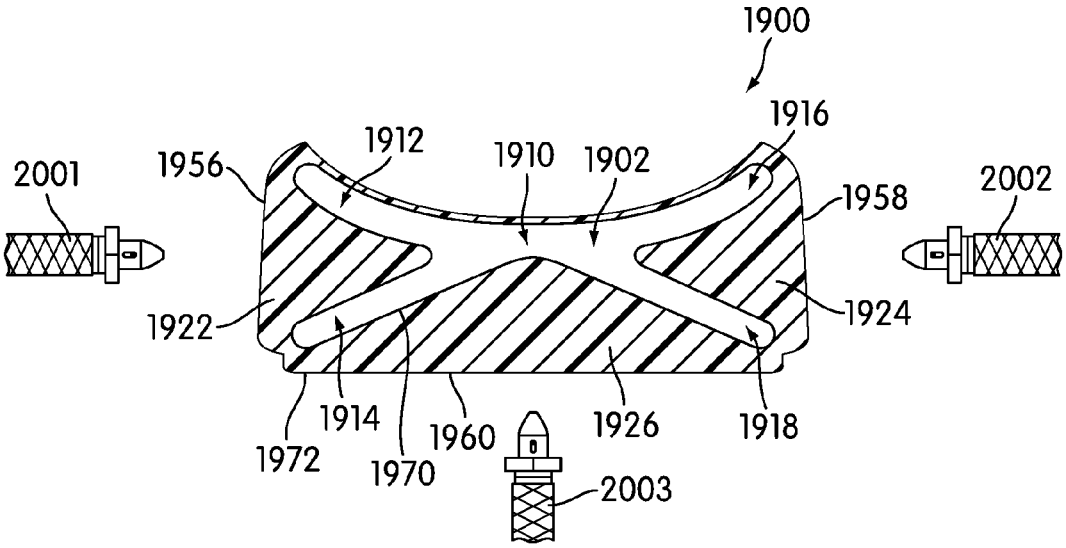
FIG. 19 illustrates a cross sectional view of an embodiment of a sole structure during a process of forming a plurality of slots.
Figure 20:
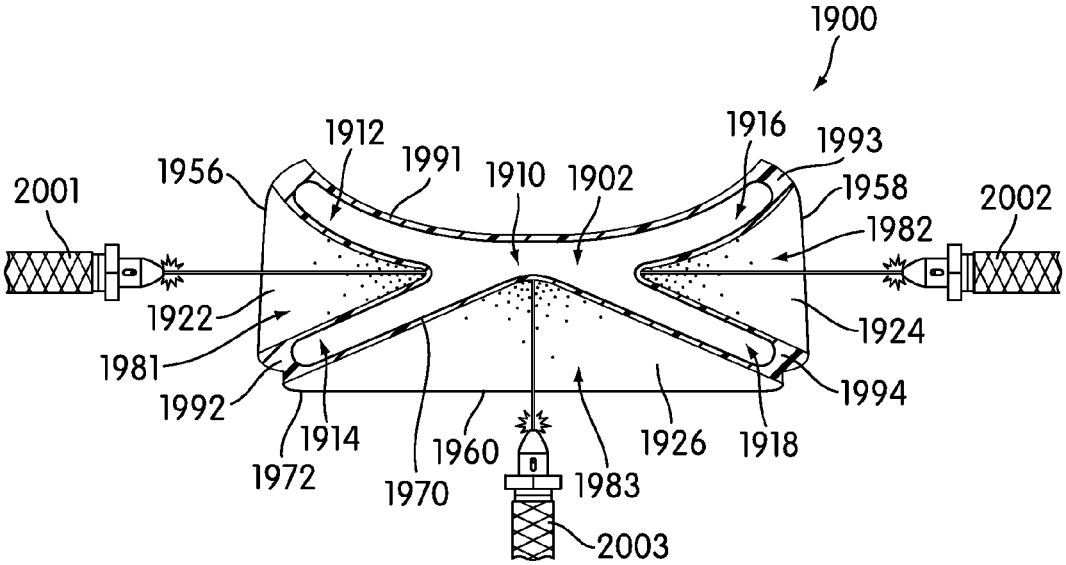
FIG. 20 illustrates a cross sectional view of an embodiment of a sole structure during a process of forming a plurality of slots.

FIGS. 19 and 20 illustrate an embodiment of a method of making a sole structure including a plurality of slots. Referring to FIGS. 19 and 20, fluid filled member 1900 may be formed with internal cavity 1902. Generally, fluid filled member 1900 can be made of any material, including any material or combination of materials discussed above for a fluid filled member. Moreover, fluid filled member 1900 can be made using any method known in the art for making fluid filled members including any methods for forming bladders.

Internal cavity 1902 may include lateral upper cavity portion 1912, lateral lower cavity portion 1914, medial upper cavity portion 1916 and medial lower cavity portion 1918. Internal cavity 1902 can also include central cavity portion 1910. In this embodiment, internal cavity 1902 has an approximately X-like cross sectional shape. However, in other embodiments, internal cavity 1902 could have any other cross sectional shape.

Fluid filled member 1900 can include lateral side portion 1956, medial side portion 1958 and lower portion 1960. Moreover, fluid filled member 1900 may include lateral thickened portion 1922, medial thickened portion 1924 and lower thickened portion 1926 that are associated with lateral side portion 1956, medial side portion 1958 and lower portion 1960, respectively. In particular, each thickened portion may extend from boundary 1970 of internal cavity 1902 to outer boundary 1972 of fluid filled member 1900.

In this embodiment, multiple lasers could be used to simultaneously form three longitudinally aligned slots in fluid filled member 1900. In particular, first laser 2001, second laser 2002 and third laser 2003 may be associated with lateral side portion 1956, medial side portion 1958 and lower portion 1960, respectively. As seen in FIG. 20, first laser 2001, second laser 2002 and third laser 2003 may be used to remove material from lateral thickened portion 1922, medial thickened portion 1924 and lower thickened portion 1926, respectively. This helps to form first slot 1981, second slot 1982 and third slot 1983. Furthermore, the remaining material comprises first connecting member 1991, second connecting member 1992, third connecting member 1993 and fourth connecting member 1994 that provide connection between adjacent segmented portions of fluid filled member 1900. This slotted arrangement helps to provide increased flexibility between segmented portions as discussed in detail above.

Although the current embodiment illustrates a method of forming slots in a fluid filled member using laser cutting, other methods of forming slots could include hot knife methods as well as any other methods discussed above for forming slots in one or more materials.

Figure 21:
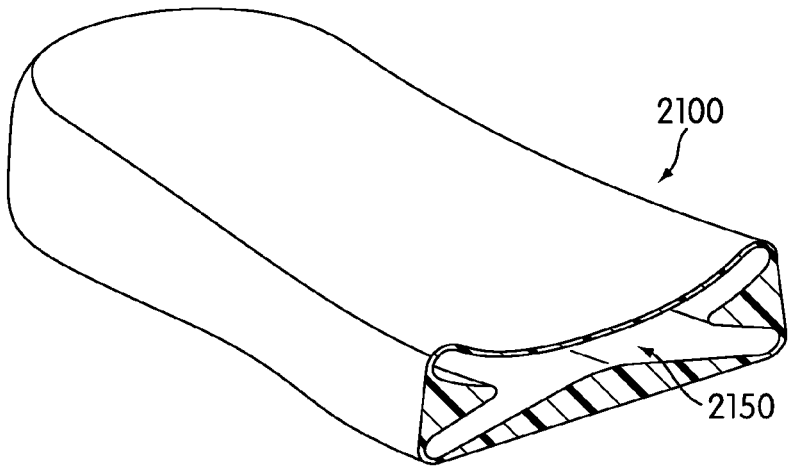
FIG. 21 illustrates an isometric view of an embodiment of a supporting member for a sole structure.

FIGS. 21 through 24 are intended to illustrate an embodiment of another method for forming a sole structure with a plurality of slots. Referring to FIG. 21, during a first step, supporting member 2100 can be formed. Supporting member 2100 may be made of any material including any of the materials discussed above for fluid filled members, segmented portions or any other portions of a sole structure. In some cases, supporting member 2100 may be made of a plastic material. In other cases, supporting member 2100 may be made of a foam material. In still other cases, supporting member 2100 could be made of any other material. Moreover, supporting member 2100 could be made by a molding process or any other kind of process.

Supporting member 2100 may be formed with hollow cavity 2150. Hollow cavity 2150 may extend throughout the full length or a portion of the length of supporting member 2100. In different embodiments, the cross sectional shape of hollow cavity 2150 could vary. In some cases, for example, hollow cavity 2150 may have an X-like cross sectional shape. In other cases, hollow cavity 2150 could have a rectangular cross sectional shape, an irregular cross sectional shape or any other kind of cross sectional shape.

Figure 22:
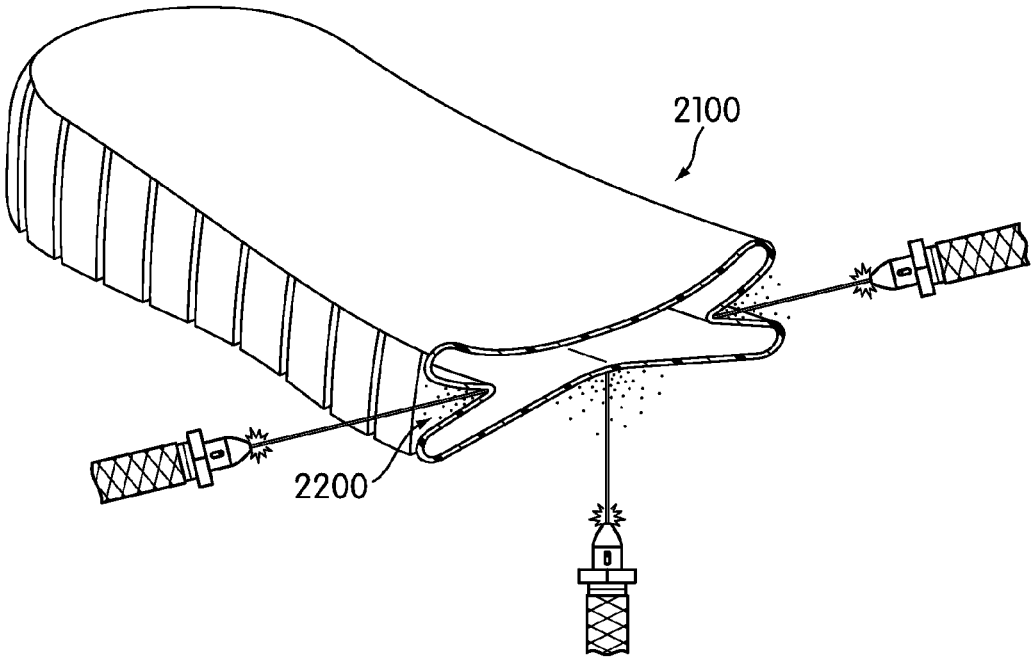
FIG. 22 illustrates an isometric view of an embodiment of a process for forming a plurality of slots in a support member for a sole structure.

Next, as seen in FIG. 22, plurality of slots 2200 may be formed in supporting member 2100. Plurality of slots 2200 may be formed in any manner, including laser cutting, hot knife processes as well as any other methods. In some embodiments, support member 2100 could be pre-molded with plurality of slots 2200, rather than forming slots after supporting member 2100 has already been formed.

Figure 23:
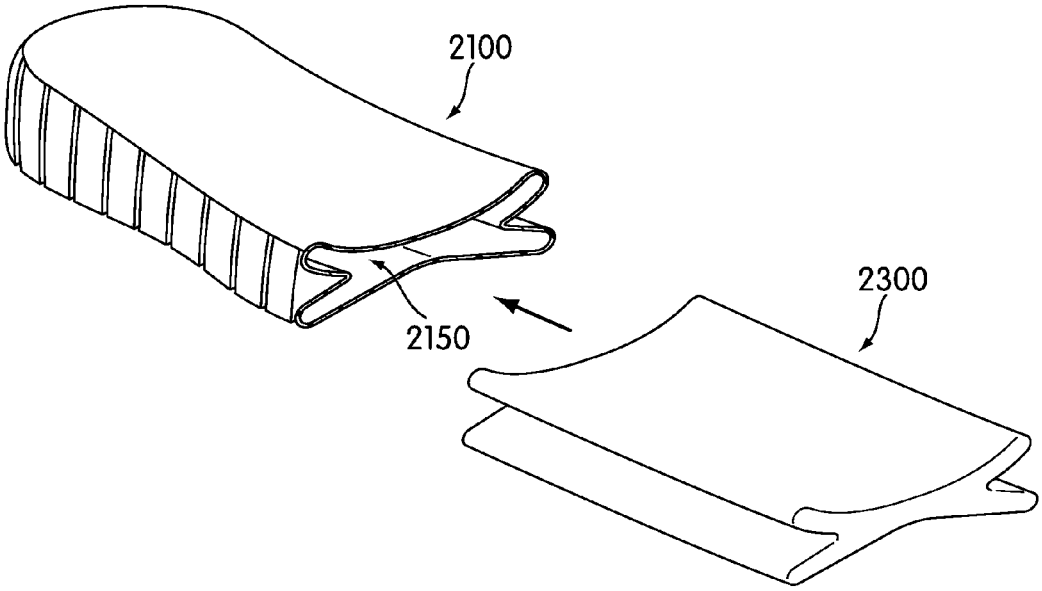
FIG. 23 illustrates an isometric view of an embodiment of a process of assembling a support member with a fluid filled member.

Referring to FIG. 23, supporting member 2200 may be associated with fluid filled member 2300. Fluid filled member 2300 could be any kind of fluid member. In some cases, fluid filled member 2300 can be substantially similar to fluid filled member 1420, which is shown in FIGS. 14 and 15. In other embodiments, however, fluid filled member 2300 could be any other kind of fluid filled member. In one embodiment, fluid filled member 2300 may have an approximately X-like cross sectional shape. In other cases, fluid filled member 2300 may have any other cross sectional shape including a rectangular cross sectional shape or an irregular cross sectional shape.

Figure 24:
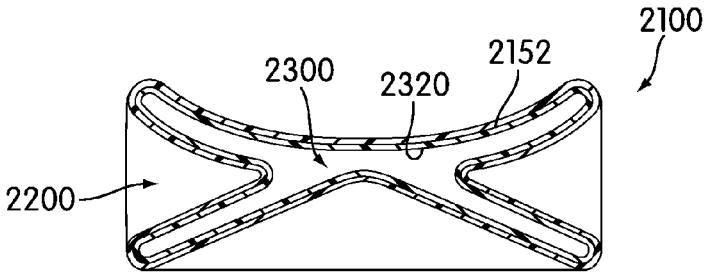
FIG. 24 illustrates a cross sectional view of an embodiment of a sole structure including a support member and a fluid filled member.

In one embodiment of a method of forming a sole structure, fluid filled member 2300 may be inserted into hollow cavity 2150 of supporting member 2200, as seen in FIGS. 23 and 24. In particular, in an exemplary embodiment, hollow cavity 2150 and fluid filled member 2300 may have substantially similar cross sectional shapes so that fluid filled member 2300 fits snugly into hollow cavity 2150.

After fluid filled member 2300 is inserted into hollow cavity 2150, fluid filled member 2300 may be bonded to hollow cavity 2150. In some cases, an adhesive may be used to bond outer layer 2320 of fluid filled member 2300 to interior wall 2152 of hollow cavity 2150. In other cases, fluid filled member 2300 may be bonded to hollow cavity 2150 in another manner. In another embodiment, fluid filled member 2300 may not be bonded directly to hollow cavity 2150.

Generally, any methods for combining a fluid filled member and a supporting member can be used. Examples of methods for combining a fluid filled member and a supporting member may be found in U.S. Pat. No. 7,562,469, the entirety of which is hereby incorporated by reference. Additionally, while the current embodiment uses a supporting member that completely encloses a hollow cavity, in other embodiments, a supporting member could be configured in any other manner. In some cases, for example, a supporting member could comprise a cage-like structure that provides support to two or more surfaces of a fluid filled member. In other words, in other embodiments the supporting member may only cover some surfaces of a fluid filled member.

This arrangement provides a sole structure for an article of footwear comprising supporting member 2100 and fluid filled member 2300. In particular, the resulting sole structure may comprise adjacent segmented portions that are separated by plurality of slots 2200 in order to improve flexibility for the sole structure.

In different embodiments, the material properties of supporting member 2100 and fluid filled member 2300 could vary. In some cases, supporting member 2100 may be substantially more rigid than fluid filled member 2300. In other cases, supporting member 2100 may be substantially less rigid than fluid filled member 2300. In still other cases, supporting member 2100 and fluid filled member 2300 may have substantially similar rigidities. In an exemplary embodiment, supporting member 2100 may be substantially more rigid than fluid filled member 2300 in order to provide support for fluid filled member 2300.

It will be understood that in different embodiments, slots could be associated with various different portions of a sole structure. Moreover, in some cases, a fluid filled member could be associated with different portions of a sole structure. In some cases, slots and/or a fluid filled member could be associated with a majority of the length of the sole structure. In other cases, slots and/or a fluid filled member could be associated with only some portions of a sole structure. For example, in some cases, slots and/or a fluid filled member could be disposed in a forefoot portion of a sole structure. In other cases, slots and/or a fluid filled member could be disposed in a midfoot portion of an upper. In still other cases, slots and/or a fluid filled member could be disposed in a heel portion of a sole structure. Moreover, in some cases, slots and/or a fluid filled member could be disposed on a single side of a sole structure, such as the medial or lateral side. In still other cases, slots and/or a fluid filled member could be disposed only on a lower portion of a sole structure. In embodiments where features are only disposed on some portions of a sole structure, the sole structure could include additional provisions for enhancing support and/or comfort. These different provisions could include, but are not limited to airbags, bladders and cushions as well as any types of fluid filled members.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. An article of footwear, comprising:

a sole structure comprising a sealed fluid filled member, wherein the fluid filled member is comprised of a fluid filled bladder;

the fluid filled member including a portion with a channel extending between a first periphery and a second periphery of the sole structure, the channel receiving a plurality of segmented portions;

wherein the plurality of segmented portions are spaced apart from one another in a longitudinal direction in a manner that forms slots between the plurality of segmented portions;

wherein the channel has a first depth and a second depth, wherein the second depth is disposed further from the first periphery than the first depth;

wherein at least one segmented portion of the plurality of segmented portions has a first end portion, a second end portion, and an intermediate portion;

the first end portion extending to the first periphery of the sole structure and the second end portion extending to the second periphery of the sole structure, thereby forming a vertical wall of the segmented portion;

the first end portion having a first thickness, the second end portion having a second thickness, and the intermediate portion having a third thickness, wherein the intermediate portion is disposed further from the first periphery than the first end portion;

wherein the third thickness is greater than the first thickness and wherein the third thickness is greater than the second thickness; and wherein the at least one segmented portion has a triangular cross-sectional shape.

2. The article of footwear according to claim 1, wherein the fluid filled member is filled with a gas.

3. The article of footwear according to claim 1, wherein the first periphery and the second periphery are located along a medial side of the article of footwear.

4. The article of footwear according to claim 1, wherein the plurality of segmented portions comprise a foam material.

5. The article of footwear according to claim 1, wherein the channel is disposed on a side portion of the fluid filled member.

6. The article of footwear according to claim 1, wherein the channel is disposed on a lower portion of the fluid filled member.

7. An article of footwear, comprising:

a sole structure including a fluid filled member, wherein the fluid filled member includes an interior cavity that is sealed;

the interior cavity including a central cavity portion, a lateral upper cavity portion, a lateral lower cavity portion, a medial upper cavity portion and a medial lower cavity portion, the central cavity portion, the lateral upper cavity portion, the lateral lower cavity portion, the medial upper cavity portion and the medial lower cavity portion all being in fluid communication with one another at a similar longitudinal position;

the fluid filled member including a lateral channel extending substantially along the length of the fluid filled member located between the lateral upper cavity portion and the lateral lower cavity portion;

the fluid filled member including a medial channel extending substantially along the length of the fluid filled member located between the medial lower cavity portion and the medial upper cavity portion;

a first segmented portion and a second segmented portion separate from the first segmented portion located in the lateral channel, and a third segmented portion and a fourth segmented portion separate from the third segmented portion located in the medial channel;

the fluid filled member including a lower portion located between the lateral lower cavity portion and the medial lower cavity portion;

a first slot disposed adjacent to and separating the first segmented portion and the second segmented portion, a second slot disposed adjacent to and separating the third segmented portion and the fourth segmented portion, and a third slot disposed adjacent to the lower portion;

wherein the first slot is disposed vertically between the lateral upper cavity portion and the lateral lower cavity portion, the second slot is disposed vertically between the medial lower cavity portion and the medial upper cavity portion; and wherein the first slot, the second slot and the third slot are aligned in a longitudinal direction, the longitudinal direction extending from a forefoot portion of the sole structure to a heel portion of the sole structure.

8. The article of footwear according to claim 7, wherein the sole structure has a first portion associated with a first longitudinal position and a second portion associated with a second longitudinal position, wherein the second longitudinal position corresponds to the longitudinal position of the first slot, the second slot and the third slot.

9. The article of footwear according to claim 8, wherein a cross-sectional area of the second portion of the sole structure is approximately X-like.

10. The article of footwear according to claim 7, wherein the fluid filled member is filled with a gas.

11. The article of footwear according to claim 7, wherein a longest dimension of the first slot is oriented in a vertical direction.

12. The article of footwear according to claim 7, wherein the first segmented portion comprises a foam material.

13. The article of footwear according to claim 7, wherein each of the first segmented portion, the second segmented portion, the third segmented portion, and the fourth segmented portion has a triangular cross-sectional shape.

14. The article of footwear according to claim 7, wherein each of the first segmented portion, the second segmented portion, the third segmented portion, and the fourth segmented portion comprises a foam material and has a triangular cross-sectional shape.

15. An article of footwear, comprising:

a sole structure comprising a sealed fluid filled member, wherein the fluid filled member is comprised of a fluid filled bladder;

the fluid filled member including a portion with a channel extending between a first periphery and a second periphery of the sole structure, the channel receiving a plurality of segmented portions;

wherein the plurality of segmented portions are spaced apart from one another in a longitudinal direction in a manner that form a plurality of slots between the plurality of segmented portions;

wherein at least one slot of the plurality of slots has a first end portion, a second end portion, and an intermediate portion located between the first end portion and the second end portion;

the first end portion disposed adjacent to the first periphery of the sole structure and the second end portion disposed adjacent to the second periphery of the sole structure;

the first end portion having a first depth, the second end portion having a second depth, and the intermediate portion having a third depth;

wherein the third depth is greater than the first depth, and wherein the third depth is greater than the second depth; and wherein at least one segmented portion of the plurality of segmented portions has a triangular cross-sectional shape.

16. The article of footwear according to claim 15, wherein the fluid filled member is filled with a gas.

17. The article of footwear according to claim 15, wherein the first periphery and the second periphery are located along a medial side of the article of footwear.

18. The article of footwear according to claim 15, wherein the plurality of segmented portions comprise a foam material.

19. The article of footwear according to claim 15, wherein the channel is disposed on a side portion of the fluid filled member.

20. The article of footwear according to claim 15, wherein the channel is disposed on a lower portion of the fluid filled member.

* * * * *